US011839990B2

(12) United States Patent
Marovic et al.

(10) Patent No.: US 11,839,990 B2
(45) Date of Patent: Dec. 12, 2023

(54) KNIFE WITH A KNIFE HANDLE AND A BLADE

(71) Applicant: KNIPEX-Werk C. Gustav Putsch KG, Wuppertal (DE)

(72) Inventors: Filip Marovic, Wuppertal (DE); Rainer Messerschmidt, Duesseldorf (DE); Bernd Riepe, Wuppertal (DE)

(73) Assignee: KNIPEX-WERK C. GUSTAV PUTSCH KG, Wuppertal (DE)

( * ) Notice: Subject to any disclaimer, the term of this patent is extended or adjusted under 35 U.S.C. 154(b) by 352 days.

(21) Appl. No.: 17/271,957

(22) PCT Filed: Aug. 27, 2019

(86) PCT No.: PCT/EP2019/072782
§ 371 (c)(1),
(2) Date: Feb. 26, 2021

(87) PCT Pub. No.: WO2020/043696
PCT Pub. Date: Mar. 5, 2020

(65) Prior Publication Data

US 2021/0323178 A1 Oct. 21, 2021

(30) Foreign Application Priority Data

Aug. 27, 2018 (DE) ..... 10 2018 120 861.8

(51) Int. Cl.
*B26B 5/00* (2006.01)

(52) U.S. Cl.
CPC ..... *B26B 5/003* (2013.01); *B26B 5/002* (2013.01)

(58) Field of Classification Search
None
See application file for complete search history.

(56) References Cited

U.S. PATENT DOCUMENTS 4,240,202 A 12/1980 Gilbert
D436,825 S 1/2001 Chen
(Continued)

FOREIGN PATENT DOCUMENTS

CN 301622451 S 7/2011
CN 301692553 S 10/2011
(Continued)

OTHER PUBLICATIONS

English translation of JP 8-215443, publication date Aug. 1996.*
(Continued)

*Primary Examiner* — Hwei-Siu C Payer
(74) *Attorney, Agent, or Firm* — Collard & Roe. P.C.

(57) ABSTRACT

A knife has a knife handle and a blade, the blade being extendable and retractable in relation to the knife handle. A reinforcing part is provided which can support an extended portion of the blade, and is movable in respect of the knife handle and is detachably connected to the blade. Alternatively, the knife has a blade-moving carriage and/or a reinforcing part-moving carriage and a latching holder for latch-adjusting different extended positions of the blade is provided. In another embodiment, the blade-moving carriage has a holding magnet for holding cooperation with the blade. In yet another embodiment, a closing cap is arranged on the knife handle at the rear end of the blade, the closing cap closing the movement path for the blade-moving carriage and/or the reinforcement part-moving carriage.

14 Claims, 32 Drawing Sheets

(56) References Cited

U.S. PATENT DOCUMENTS

| | | | | |
|---|---|---|---|---|
| D443,494 | S | 6/2001 | Okada | |
| 6,484,404 | B1 | 11/2002 | Kao | |
| D596,474 | S | 7/2009 | Groten | |
| D735,552 | S | 8/2015 | Hung | |
| 9,358,692 | B2 | 6/2016 | Schekalla | |
| 9,409,299 | B2 | 8/2016 | Segler | |
| 2005/0193568 | A1 | 9/2005 | Peyrot et al. | |
| 2009/0188115 | A1 | 7/2009 | Van Deursen | |
| 2014/0059864 | A1* | 3/2014 | Segler | B26B 5/002 30/162 |
| 2016/0136825 | A1 | 5/2016 | Hsu | |
| 2018/0200898 | A1 | 7/2018 | Kierecki | |
| 2021/0323178 | A1* | 10/2021 | Marovic | B26B 5/002 |

FOREIGN PATENT DOCUMENTS

| | | | | |
|---|---|---|---|---|
| CN | 302369791 | S | | 3/2013 |
| DE | 10 2005 038 308 | A1 | | 10/2006 |
| DE | 10 2011 007 234 | B3 | | 9/2012 |
| EP | 2 703 133 | A1 | | 3/2014 |
| JP | 8-215443 | | * | 8/1996 |
| JP | 10-263217 | | * | 10/1998 |
| KR | 10-2005-0083234 | | * | 8/2005 |
| TW | M444922 | U1 | * | 1/2013 |
| WO | 99/07526 | A1 | | 2/1999 |
| WO | 2008/066365 | A1 | | 6/2008 |

OTHER PUBLICATIONS

English translation of JP 10-263217, publication date Oct. 1998.*
International Search Report of PCT/EP2019/072782, dated Jan. 21, 2020.

* cited by examiner 1
2
3
4
5
6
8
9
10
11
12
13
14
16
17
19
20
21
22
23
24
25
26
27
28
29
30
31
32
33
34
35
39
44
45
46
47
48
50
55
56
57
58
59
60
61
66

1
48
49
52
33
45
46
44
34
50
35
66
40
54
65
62
32
39
64
29
56
61
30
31
3
19
28
25
16
17
20
55
21
47
9
27
24
13
5
12
4
6
2
10
14

48
48
33
33
34
73
34
72
69
72
50
50
73
76,35
76,35
31
30
32
32
67
78
70
78
77
68
78
77
78
7
7
5
8
5
80
85
4
61
29
16
59
11
17
82
58
57
3
84
83
4
5
81
6
9
83

KNIFE WITH A KNIFE HANDLE AND A BLADE

CROSS REFERENCE TO RELATED APPLICATIONS

This application is the National Stage of PCT/EP2019/072782 filed on Aug. 27, 2019, which claims priority under 35 U.S.C. § 119 of German Application No. 10 2018 120 861.8 filed on Aug. 27, 2018, the disclosure of which is incorporated by reference. The international application under PCT article 21(2) was not published in English.

TECHNICAL FIELD

The invention relates to a knife with a knife handle and a blade, wherein the blade can be extended and retracted relative to the knife handle.

PRIOR ART

Knives of the type in question are also called "cutter knives," "carpet knives," "Japan knives" or "Stanley knives." These knives are provided with a knife handle, in which a blade is in a non-usage position of the knife accommodated in a retracted manner. In order to transfer the blade into a usage position, this blade is extended relative to the knife handle, namely over at least a section of the blade referred to its length, such that at least a blade tip region freely protrudes beyond an end of the knife handle.

In this context, two different variations of the blade are basically known. According to one variation, the blade is realized in the form of a rigid blade that optionally can be inserted in different positions or orientations and exchanged after it is worn out whereas the blade according to the second variation is realized in the form of a so-called snap-off blade or segmental blade, on which a front blade segment in the extending direction is snapped off along a predetermined breaking point after it is worn out.

With respect to the prior art, we refer, for example, to DE 10 2005 038 308 A1 or also to DE 10 2011 007 234 B3.

SUMMARY OF THE INVENTION

In light of the above-described prior art, an objective of the invention can be seen and additionally enhancing a knife of the type in question, particularly in terms of its handling.

According to a first inventive idea, this objective is potentially attained with a knife that is provided with a reinforcing part, on which an extended region of the blade can be supported, wherein the reinforcing part is displaceable relative to the knife handle and detachably connected to the blade.

The reinforcing part provides a support for the blade in its extended state, particularly in a bending direction of the blade, which extends perpendicular to a broad face thereof and in which the blade would be bent without a reinforcing part when the blade is subjected to corresponding stress. Depending on the application of the knife, as well as the length of extension of the blade relative to the knife handle, such a potential bending stress on the blade can lead to uncontrollable breakage of the blade and optionally to a fracture along a predetermined breaking point between two blade segments. The reinforcing part counteracts such a bending stress and accordingly stabilizes, in particular, the extended region of the blade. Furthermore, the thusly achieved stability of the extended region of the blade makes it possible to produce an exact cut.

The reinforcing part, as well as the blade itself, may be displaceable relative to the knife handle such that it preferably can be extended and retracted in the displacement direction of the blade. This sliding displaceability of the reinforcing part may be coupled to that of the blade such that a sliding displacement of the blade in the extending or retracting direction may result in a corresponding extension or retraction of the reinforcing part.

The reinforcing part may alternatively also be displaceable independently of the blade. This provides the user with the option of selectively associating the reinforcing part with the extended region of the blade such that the user can, if so required, also utilize the blade under—moderate—bending stress. As a result of such a design, the reinforcing part furthermore can also be transferred into a blade support position over only a section of the extended region of the blade or alternatively over the entire extended region of the blade.

In a knife that has a blade displacement carriage and/or a reinforcing part displacement carriage and is provided with a catch retention for the indexed adjustment of different extending positions of the blade, the above-defined objective may potentially be attained in that the catch mechanism is formed underneath the region, in which the blade or an imaginary extension of the blade extends, viewed from the blade displacement carriage and/or the reinforcing part displacement carriage.

Knives of the type in question have a displacement carriage, which particularly serves for extending and retracting the blade and is functionally connected to the blade, e.g. as a result of a form-fitted connection. In this case, the displacement carriage may have an outwardly directed handling element for the user, by means of which a sliding displacement of the displacement carriage and thereby the blade can be achieved.

The catch mechanism provided, in particular, between the displacement carriage and the knife handle makes it possible to realize different extending positions, as well as different retracting positions, of the blade and/or a provided reinforcing part. In connection with segmented snap-off blades, it is known to offer catching positions of the displacement carriage and therefore of the blade in dependence on the spacing between the predetermined breaking points between two blade segments.

According to the invention, the catch engagement, particularly between the displacement carriage and the knife handle, especially the knife handle housing or a fixed part connected to the housing, respectively takes place underneath the region, in which the blade or an imaginary extension of the blade extends, viewed from the displacement carriage or, referred to the outwardly directed handling element of the displacement carriage for the user, on the underside of the blade or a blade plane formed by the lower broad side face of the blade that faces away from the handling element. With respect to the handling element of the displacement carriage that faces the user, it is therefore possible to form a catch mechanism that is at least over the region of the blade covered by the blade, as well as by the displacement carriage itself. A concealed catch mechanism can thereby be realized.

Another solution concerns a knife, in which the blade displacement carriage has a retaining magnet for interacting with the blade in a retaining manner.

According to the invention, the preferably provided retaining magnet may serve for promoting the retention of the blade on the associated displacement carriage, particularly in the course of fitting the displacement carriage with a new blade (blade exchange). The retaining magnet may be provided in addition to a potential form-fitted connection between the displacement carriage and the blade. Furthermore, the magnetic force may be chosen such that the blade is on the one hand securely retained on the blade displacement carriage and accordingly does not fall off the displacement carriage, e.g. in an overhead position, but can on the other hand be removed from the blade displacement carriage by the user without tools during a potential blade exchange.

Another solution may be characterized in that a closing cap is arranged on the knife handle at the rear end of the blade, wherein said closing cap closes the displacement path for the blade displacement carriage and/or the reinforcing part displacement carriage.

According to a potential embodiment, the blade displacement carriage and/or the reinforcing part displacement carriage essentially can be displaced in the blade displacement direction and/or the reinforcing part displacement direction over the entire longitudinally extent of the knife handle. The sliding displaceability of the displacement carriage in the extending direction may be limited by means of a stop. This makes it possible to prevent an unintentional displacement of the displacement carriage, as well as the blade optionally arranged thereon, beyond the facing end face of the knife handle.

In order to allow a blade exchange, for example, the blade displacement carriage particularly can be displaced beyond the corresponding end of the knife handle in the opposite displacement direction, i.e. in the retracting direction, wherein the catch mechanism between the displacement carriage and the knife handle preferably is disengaged in the process. The blade—and accordingly the reinforcing part of a corresponding reinforcing part displacement carriage—can subsequently be removed from the region of the knife handle in its entirety.

The sliding displaceability of the blade displacement carriage and/or the reinforcing part displacement carriage in the retracting direction is during normal usage of the knife likewise limited by means of a stop. This limit stop may be formed by a closing cap that essentially blocks the displacement path transverse to the displacement direction. The displacement carriage can be displaced against this limit stop. The closing cap can be removed in order to release the displacement path, e.g. for the purpose of a blade exchange.

The characteristics of the above-described independent claims respectively are important individually, as well as in any combination with one another, wherein characteristics of an independent claim can furthermore be combined with the characteristics of another independent claim or with characteristics of multiple independent claims, as well as with only individual characteristics of one or more other independent claims.

For example, the above-defined objective may therefore also be attained with a knife, in which a reinforcing part that can be displaced relative to the knife handle is provided for the blade, wherein the catch mechanism between the displacement carriage and the knife handle may be formed underneath the blade or an imaginary extension of the blade and/or the blade displacement carriage has a retaining magnet for interacting with the blade in a retaining manner, and wherein a closing cap also may be optionally arranged on the knife handle at the rear end of the blade.

Other characteristics of the invention are frequently described below, as well as in the description of the figures, in their preferred association with the object of claim 1 and/or the other independent claim(s) or with characteristics of other claims. However, they may also be important in association with only individual characteristics of claim 1 and/or the other independent claim(s) or the respective other claim or independently.

According to a potential embodiment, the reinforcing part may be displaceable relative to the blade. In this case, the displacement direction of the reinforcing part preferably extends in the same direction as that of the blade. The reinforcing part and the blade may therefore be extendable and retractable over different distances and (to a limited degree) independently of one another.

The knife handle may be realized in an elongate manner and have a longitudinal direction. During normal usage of the knife, such an elongate knife handle is essentially encompassed by the fingers of one hand of the user transverse to the longitudinal direction whereas the thumb, which can optionally also be used for actuating the displacement carriage, essentially points in the longitudinal direction.

For example, the longitudinal dimension of the knife handle may approximately correspond to 5-times to 10-times or more the lateral dimension extending transverse thereto.

According to a preferred embodiment, the blade is extendable and retractable in the longitudinal direction of the knife handle, preferably in the extending direction and in the retracting direction.

The reinforcing part may also be displaceable in the longitudinal direction of the knife handle and accordingly in the same displacement direction as the blade.

According to a potential embodiment, the reinforcing part may be designed in a rod-like manner and associated with a longitudinal outer edge of the blade, wherein the reinforcing part may according to another embodiment be designed for encompassing the outer edge of the blade. The stiffening of the blade by means of the reinforcing part accordingly takes place in the region of the outer edge of the blade, particularly the outer edge that lies opposite of the cutting edge of the blade or, in other words, in the region of the blade back.

For example, the reinforcing part may for this purpose have a U-shaped cross-sectional area in a cross section perpendicular to its longitudinal extent, wherein the reinforcing part may cover the blade region along the outer edge on the upper and the lower side with its U-limbs, which in a cross section essentially extend parallel to one another, and the outer edge of the blade extends such that it is associated with the U-crosspiece connecting the U-limbs.

The reinforcing part particularly may have such a U-shaped cross section over its entire usable length that can interact with the blade such that the reinforcing part is realized rigidly, particularly in a direction extending transverse to the extending or retracting direction.

In a cross section, the U-limbs of the reinforcing part profile may starting from the U-crosspiece connecting these limbs have a free length that corresponds to one-fifth to one-tenth or less of the width of the blade extending in the same direction and therefore transverse to the displacement direction of the blade.

In a potential embodiment, the knife handle may furthermore have a displacement receptacle for a blade receptacle carriage that is connected to the blade. The displacement receptacle forms a guide for the displacement carriage, particularly in the course of the extension or retraction of the blade. In this case, the displacement receptacle may extend in the longitudinal direction of the knife handle in a slot-like manner.

The knife handle may also have a displacement receptacle for a reinforcing part displacement carriage that is connected to the reinforcing part. Such a displacement receptacle may also extend in the longitudinal direction of the knife handle in a slot-like manner as in the above-described embodiments.

It is preferred that the blade displacement carriage and the reinforcing part displacement carriage are arranged in the same displacement receptacle. Accordingly, the preferably single displacement receptacle of the knife handle serves for guiding and optionally for retaining the blade displacement carriage, as well as the reinforcing part displacement carriage. If both displacement carriages are jointly arranged in the displacement receptacle, for example, the blade displacement carriage and the reinforcing part displacement carriage may be arranged in the displacement receptacle behind one another referred to the longitudinal direction or the displacement direction, respectively. It is furthermore preferred that the blade displacement carriage is in this case arranged in front of the reinforcing part displacement carriage referred to the extending direction.

In another embodiment, the blade may be realized in the form of a flat part that has an essentially constant thickness in a longitudinal direction, as well as in a direction extending transverse thereto. For example, the blade may be manufactured from an endless steel strip.

The blade may also have predetermined breaking points in order to snap off a worn out blade segment. In a potential blade that has an exemplary length of about 80 mm, a width of about 9 to 25 mm and an essentially constant thickness of about 0.4 to 0.7 mm, it would be possible, for example, to provide 10 to 15 such predetermined breaking points, preferably about 12 predetermined breaking points, such that a corresponding number of usable blade sections is formed.

In order to realize the catch engagement of the displacement carriage, a catch part may be accommodated in the blade displacement carriage and/or in the reinforcing part displacement carriage and catch openings or catch recesses may be provided behind one another in the longitudinal direction in the knife handle. The catch retention is realized due to the engagement of the catch part into one of the catch openings. For example, the blade displacement carriage particularly may engage with the knife handle in a catching manner in blade segment length increments. This is achieved by correspondingly spacing apart the catch openings or catch recesses in the longitudinal direction. In a potential embodiment, the catch spacing of the reinforcing part displacement carriage in the displacement direction corresponds to that of the blade displacement carriage.

The arrangement may furthermore be chosen in such a way that the catch part of the reinforcing part displacement carriage can engage into the same catch opening or catch recess as the catch part of the blade displacement carriage.

Individual catch openings, e.g. bore-like catch openings, may be provided in the knife handle. In this respect, it would also be possible to realize an altogether slot-like catch formation that extends in the longitudinal direction and has regions, which are constricted in a waist-like manner and define successive catch openings in the longitudinal direction.

According to another preferred embodiment, the catch part accommodated in the blade displacement carriage may penetrate the blade in the region of a blade opening. In such an embodiment, the catch part accordingly may not only serve for the catch retention of the displacement carriage, but also for fixing the blade on the displacement carriage in a form-fitted manner.

The catch part accommodated in the blade displacement carriage therefore can penetrate the blade in the engaged state, as well as during the movement of the blade from a first into a second catching position. Accordingly, the penetration position or form-fitted position between the blade displacement carriage and the blade preferably is retained by the catch part penetrating the blade over the entire possible displacement path of the blade while the associated displacement carriage is arranged in the displacement receptacle in a guided manner.

In another embodiment, the catch retention of the blade displacement carriage and of the blade on the displacement carriage may be realized separately. For example, a catch projection, which is realized separately of the catch part, may be provided on the blade displacement carriage and penetrate the blade opening in order to retain the blade.

In addition, the catch projection may be spring-loaded into the catching position. If the catch mechanism for the blade on the displacement carriage is realized separately, a separate spring that acts upon the catch projection may be provided for this purpose. The spring may be realized, for example, in the form of a leaf spring or also in the form of a cylindrical pressure spring or the like.

The separate catch retention of the blade on the blade displacement carriage furthermore provides the option of disengaging the catch retention of the blade without thereby affecting the catch retention of the blade displacement carriage. For this purpose, it would furthermore be possible that the catch retention of the blade on the catch projection of the blade displacement carriage can be disengaged by actuating a button provided on the housing. This button preferably can be actuated by the user from an outer side of the housing.

According to a potential embodiment, the catch retention of the blade on the blade displacement carriage can be disengaged in any displacement position of the blade displacement carriage. In a preferred embodiment, however, this catch retention of the blade can only be disengaged in a predefined displacement position of the blade displacement carriage. Furthermore, this position preferably corresponds to a maximally possible extending position of the blade together with the blade displacement carriage. A disengagement of the catch retention as a result of an actuation of the button preferably is only possible in this position.

The blade displacement carriage and/or the reinforcing part displacement carriage may have an actuating part and a carriage part, wherein the actuating part can be moved relative to the carriage part in the longitudinal direction. The actuating part is exposed toward the outside in order to be actuated by the user, e.g. with a thumb. This actuating part can be displaced in a sliding manner in the longitudinal direction of the knife housing, wherein this sliding displacement—initially—takes place relative to the carriage part that is guided in the displacement receptacle and initially blocked due to the above-described catch engagement.

When the actuating part is acted upon in the longitudinal direction, it causes the catch part to be pulled out of the catch opening—while the carriage part is correspondingly blocked—and thereby disengages the catch mechanism of the carriage part and accordingly of the corresponding displacement carriage as a whole.

After the catch mechanism has been disengaged, the actuating part may be displaceable in the longitudinal direction together with the carriage part, e.g. in order to correspondingly extend or retract the blade and/or the reinforcing part. It is advantageous that the normally thumb-actuated actuating part is solely displaced in a sliding manner in the longitudinal direction in order to correspondingly disengage the catch mechanism and to displace, for example, the blade into an extended position. This sliding displacement of the actuating part causes the disengagement of the catch mechanism, as well as the displacement of the displacement part (blade or reinforcing part) connected to the displacement carriage. In this way, the actuation is simplified in comparison with known solutions, in which the actuating part has to be depressed essentially perpendicular to the displacement direction and subsequently displaced.

According to a potential embodiment, the catch part may be spring-loaded into the catching position with the aid of a spring. This user-friendly design leads to an automatic return of the catch part in the direction of the catching position. This catching position accordingly can be assumed automatically as soon as the catch part overlaps with a catch opening. The catch part can be correspondingly lifted by means of the actuating part against the force of the spring.

In a potential embodiment, the spring may be realized in the form of a leaf spring or alternatively, for example, in the form of a normal cylindrical pressure or tension spring; furthermore, a spring element of an elastically resilient plastic material would optionally also be conceivable.

The actuating part may also interact with the carriage part by means of a spring acting in the longitudinal direction. This spring acts upon the actuating part and the carriage part in the direction of a basic position that may correspond to the catching position. Accordingly, the sliding displacement of the actuating part relative to the carriage part preferably takes place against the force of the spring.

For example, this spring may also be realized in the form of a cylindrical spring, e.g. a pressure or a tension spring, or alternatively, for example, in the form of a leg spring or an elastically resilient plastic element.

The spring that may be supported in the carriage part on both ends, however, such that it can be lifted off a respective supporting surface by the actuating element when the actuating element is acted upon in the longitudinal direction. In a basic position of the displacement carriage, in which the displacement carriage is not acted upon by the actuating part, the spring therefore may optionally be supported solely on corresponding surfaces of the carriage part on both ends. An end region of the spring is only lifted off the facing surface section of the carriage part while abutting on a corresponding surface section of the actuating part once the actuating part is displaced relative to the carriage part in a sliding manner.

A wedge carriage part may be provided in another embodiment, wherein said wedge carriage part can be moved relative to the carriage part in the longitudinal direction by means of the actuating part in order to act upon the catch part. The wedge carriage part may directly interact with the catch part in this case. This accordingly results in a direct interaction between the actuating part and the catch part. According to a potential embodiment, the wedge carriage part is displaced relative to the carriage part by means of the actuating part, preferably dragged along by the actuating part in the sliding direction. The catch part is pulled out of the catch opening in the course of this displacement by means of a wedge surface provided in the wedge carriage part.

For this purpose, the catch part may have an application surface that is exposed transverse to the longitudinal direction and serves for interacting with the wedge carriage part, particularly for interacting with a corresponding wedge surface of the wedge carriage part.

In a potential embodiment, the closing cap may be plug-mounted and/or catch-mounted on the knife handle, particularly on the handle housing. Furthermore, the closing cap may be fastened on the knife handle in a sliding manner transverse to the longitudinal extent. For example, a groove-like, form-fitted guide for the closing cap furthermore may be provided on the end of the knife handle. The sliding displacement path in the inserting direction or the attachment direction of the closing cap may be limited by means of a stop, wherein the end position, which is optionally also limited by means of a stop, may furthermore be secured, e.g. by means of a catch.

The closing cap may alternatively also be connected to the handle housing in a pivoting or folding manner.

In a potential embodiment, the outside contour of the knife handle, particularly the handle housing, transforms in the arrangement position into the contour of the closing cap in an at least approximately continuous manner, particularly in the end region having the closing cap.

According to a preferred embodiment, the closing cap can only be removed in a direction extending transverse to the longitudinal extent of the knife handle in order to thereby release the displacement receptacle guiding the displacement carriage for the rearward removal of the displacement carriage with the displacement part (blade and/or reinforcing part) arranged thereon.

In this case, the closing cap may have a groove that is exposed toward the outside in order to make available a snap-off aid when the closing cap is removed. The groove is suitable for receiving a front outer edge region of the frontmost blade segment in the extending direction, whereupon this outer edge region of the blade segment is in a cross section surrounded by the groove wall on the cap side in an essentially U-shaped manner. In terms of handling, this frontmost blade segment can then be advantageously snapped off along the predetermined breaking point by utilizing the closing cap.

In a particularly advantageous enhancement, a magnet may be arranged in the closing cap in association with the groove in order to retain a snapped off blade segment in the groove. The snapped off blade segment is securely retained in the groove of the closing cap as a result of the arrangement of the magnet. Accordingly, the blade segment is prevented from uncontrollably snapping off in the course of its removal. Secure and improved handling is thereby achieved.

In this case, the magnetic force preferably is chosen in such a way that the snapped off blade segment is securely retained in the groove, namely with consideration of the forces acting upon the blade segment in the course of its removal. The magnetic force is in turn adjusted so low that the blade segment can be easily removed from the groove, if applicable with the aid of pliers for taking hold of the blade segment.

According to a potential embodiment, the catch part may be movable essentially perpendicular to a width of the blade in order to realize its respective disengagement or engagement. Alternatively, a corresponding movement of the catch part transverse to a displacement direction of the blade displacement carriage and/or the reinforcing part displacement carriage is also possible. A reduced height of the knife as a whole can thereby be achieved.

The blade displacement carriage and/or the reinforcing part displacement carriage may have a width, wherein a width direction of the reinforcing part displacement carriage and/or the blade displacement carriage may correspond to a width of the blade, and wherein the catch part furthermore is movable in the width direction of the blade displacement carriage and/or the reinforcing part displacement carriage. In this case, the width or the width direction preferably extends transverse to a longitudinal extent of the knife blade or transverse to a displacement direction of the blade and optionally also transverse to a longitudinal extent of the knife as a whole.

The catch part may be a ball or a cylinder. In a cylindrical design of the catch part, for example, a circular disk shape, an oval cross-sectional area or even a polygonal surface may be formed transverse to a longitudinal extent.

According to another preferred embodiment, the catch part may be realized, for example, in the form of a catch pin.

The blade displacement carriage and/or the reinforcing part displacement carriage may on a longitudinal side have a catch projection for interacting with the catch part in a catching position. In a catching position, this catch projection acts upon the catch part in such a way that this catch part is pushed into an associated catch opening or catch depression, which preferably is stationary relative to the displacement carriage.

The blade displacement carriage and/or the reinforcing part displacement carriage may also have a displacement projection for interacting with the catch part in a release position. In this case, the displacement projection may be suitable for displacing the catch part out of the catching position in the course of disengaging the catch mechanism and/or for assisting in the retention of this catch part in the release position in the course of a displacement of the respective carriage.

In a preferred embodiment, the displacement projection may protrude farther than the catch projection in the width direction. In this case, the displacement projection may protrude beyond the catch projection in the width direction by a dimension, which may correspond to about one-tenth to one-third, e.g. about one-fifth, of the maximum extent of the catch part in the width direction.

In a potential embodiment, the catch projection and/or the displacement projection may be provided on a wedge carriage part, which is retained on the displacement carriage so as to be displaceable relative thereto.

BRIEF DESCRIPTION OF THE DRAWINGS

The invention is described in greater detail below with reference to the attached drawings that, however, merely show exemplary embodiments. A component, which is described with reference to one of the exemplary embodiments and not replaced with a different component in another exemplary embodiment, is therefore also described as a potentially existing component in this other exemplary embodiment. In the respective drawings:

FIG. 7 shows an enlarged detail of the region VII in FIG. 6;

FIG. 17 shows an enlarged detail of the region XVII in FIG. 16;

FIG. 18 shows an enlarged detail of the region XVIII in FIG. 16;

FIG. 37 shows an enlarged section along the line XXXVII-XXXVII in FIG. 33 concerning a catching position;

DESCRIPTION OF THE EMBODIMENTS

Figure 1:
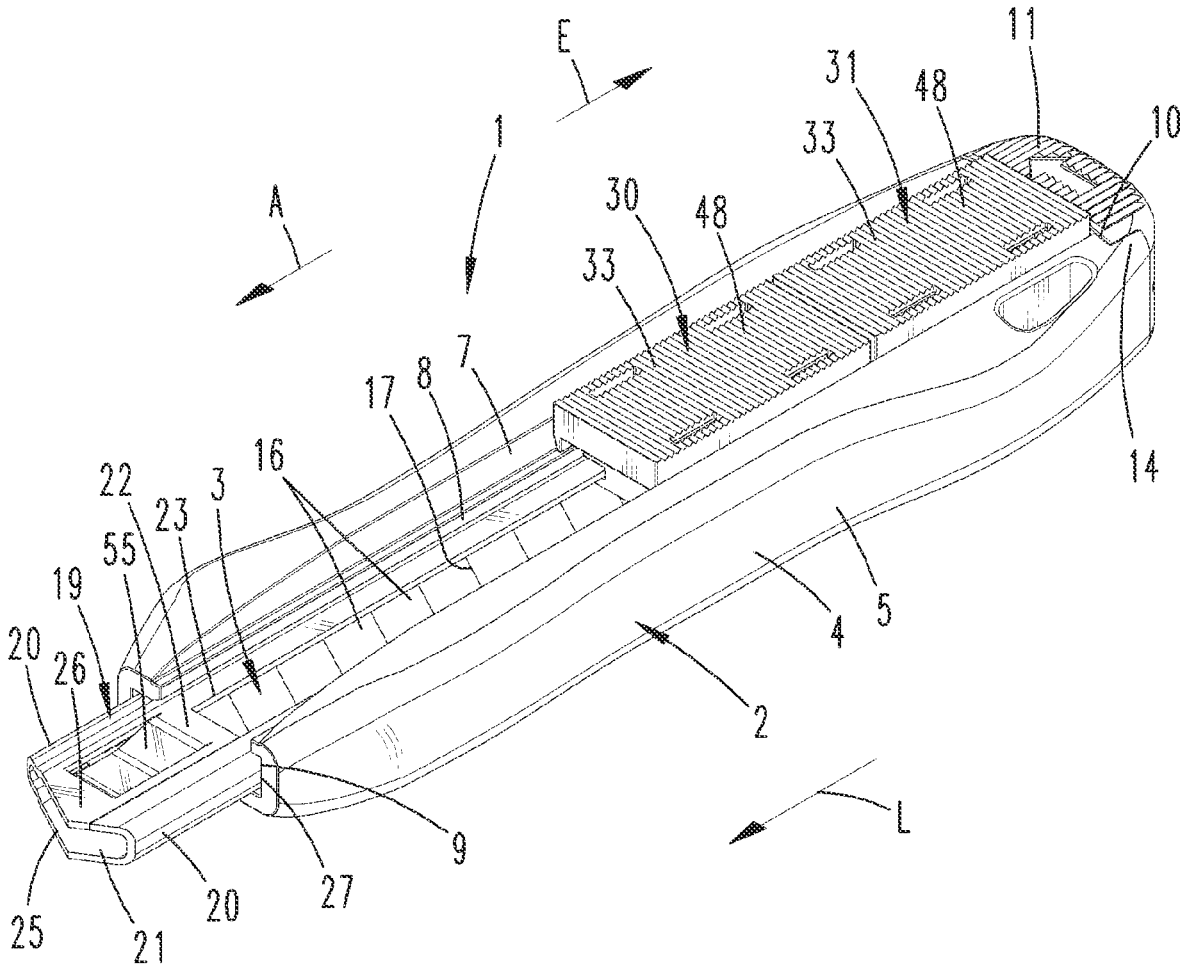
FIG. 1 shows the knife in the form of a perspective view concerning a first embodiment.
Figure 2:
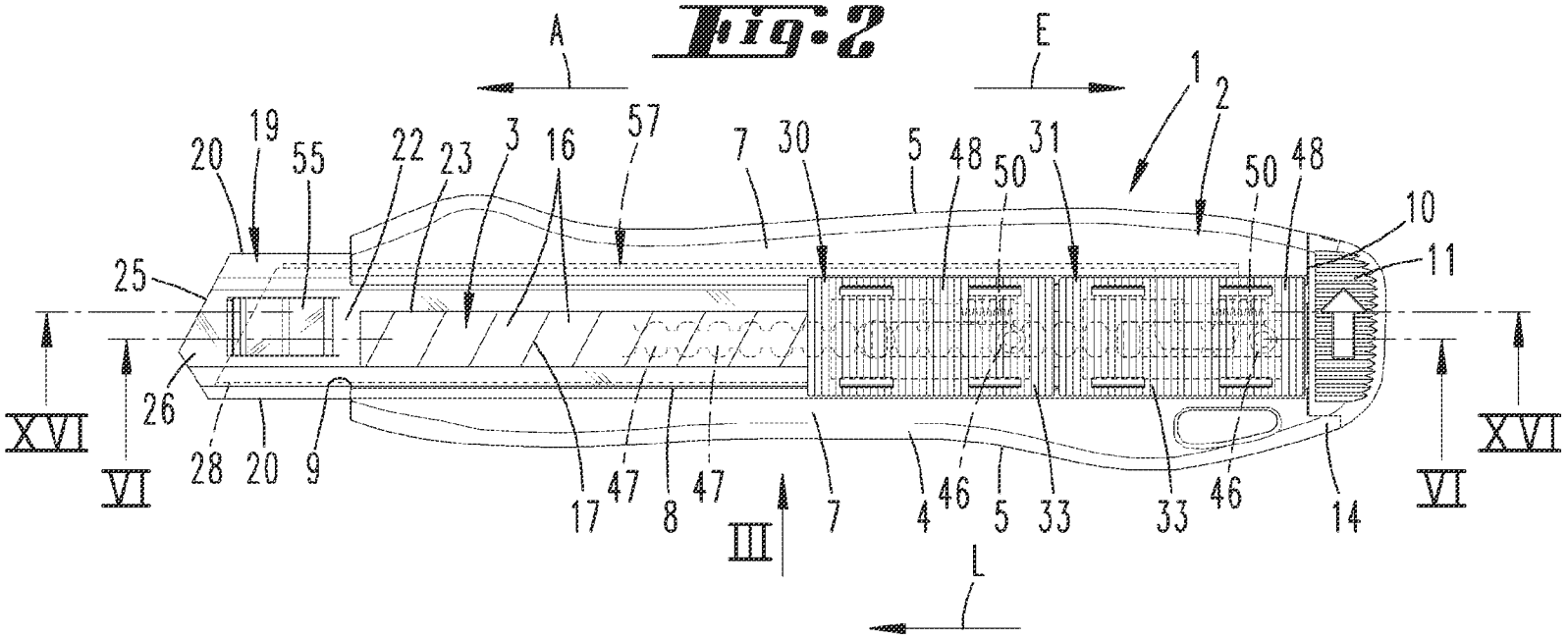
FIG. 2 shows a top view of the knife.
Figure 3:
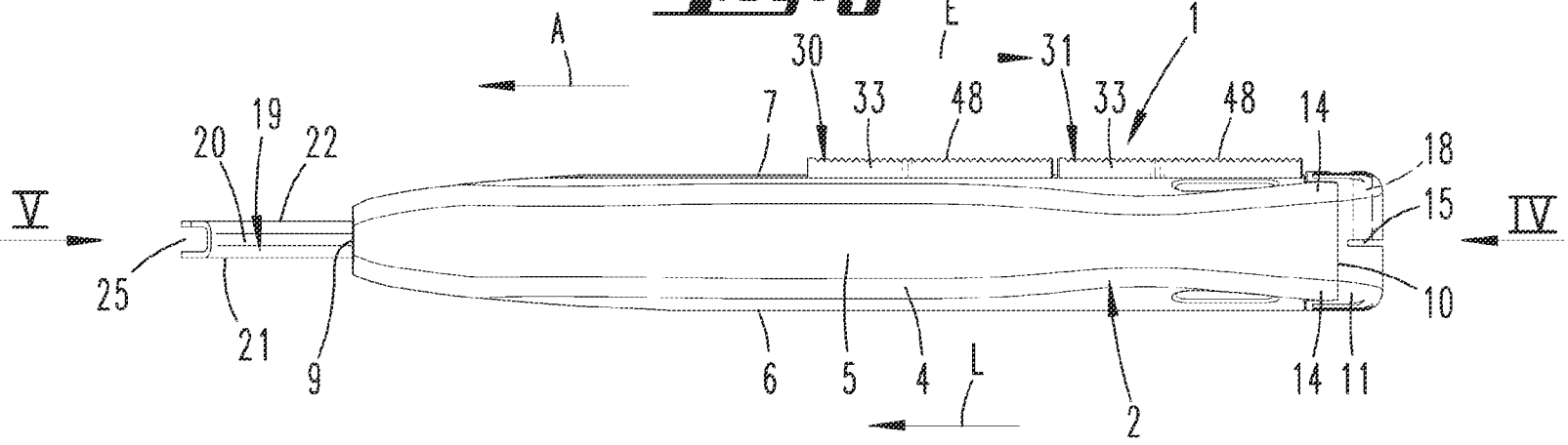
FIG. 3 shows a side view of the knife.
Figure 4:
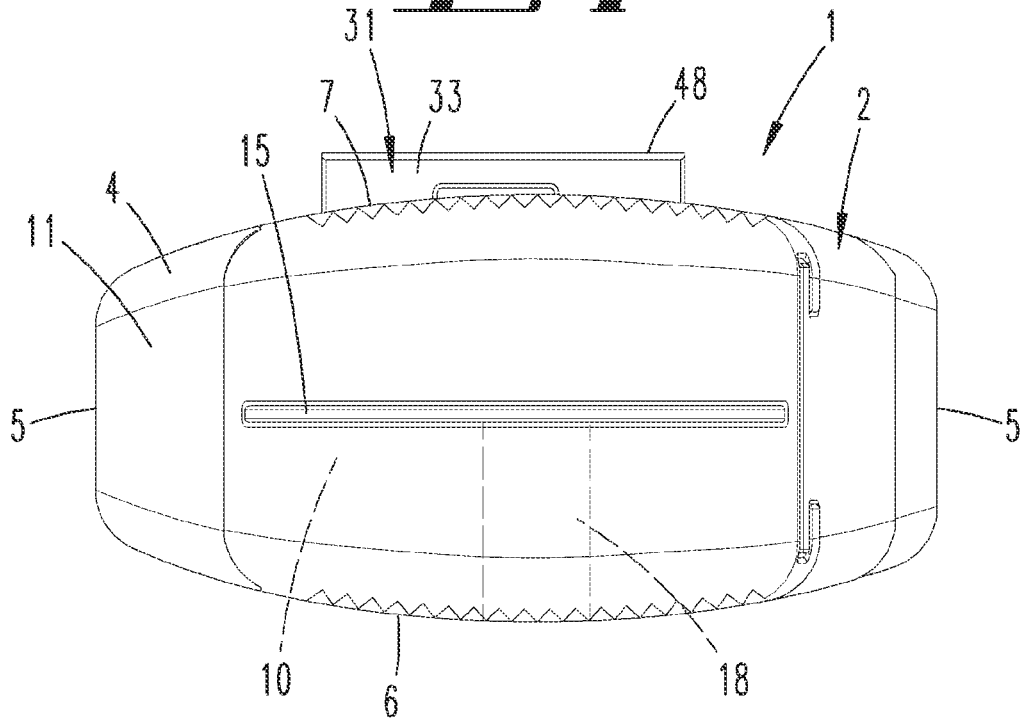
FIG. 4 shows a rear view of the knife.
Figure 5:
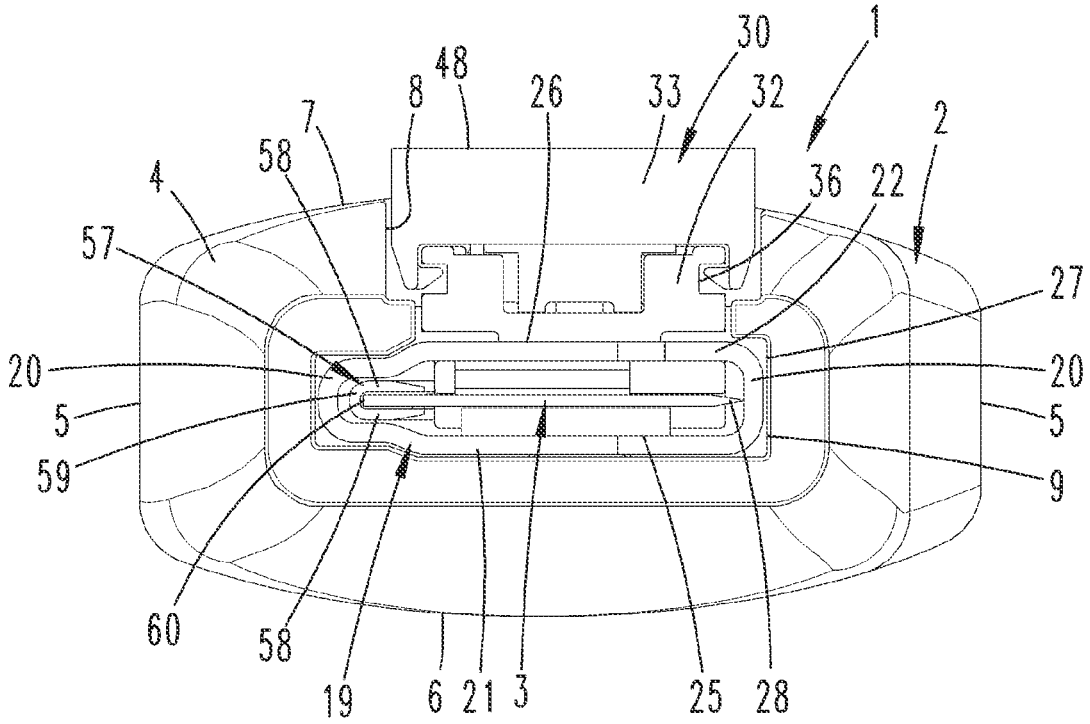
FIG. 5 shows a front view of the knife.
Figure 6:
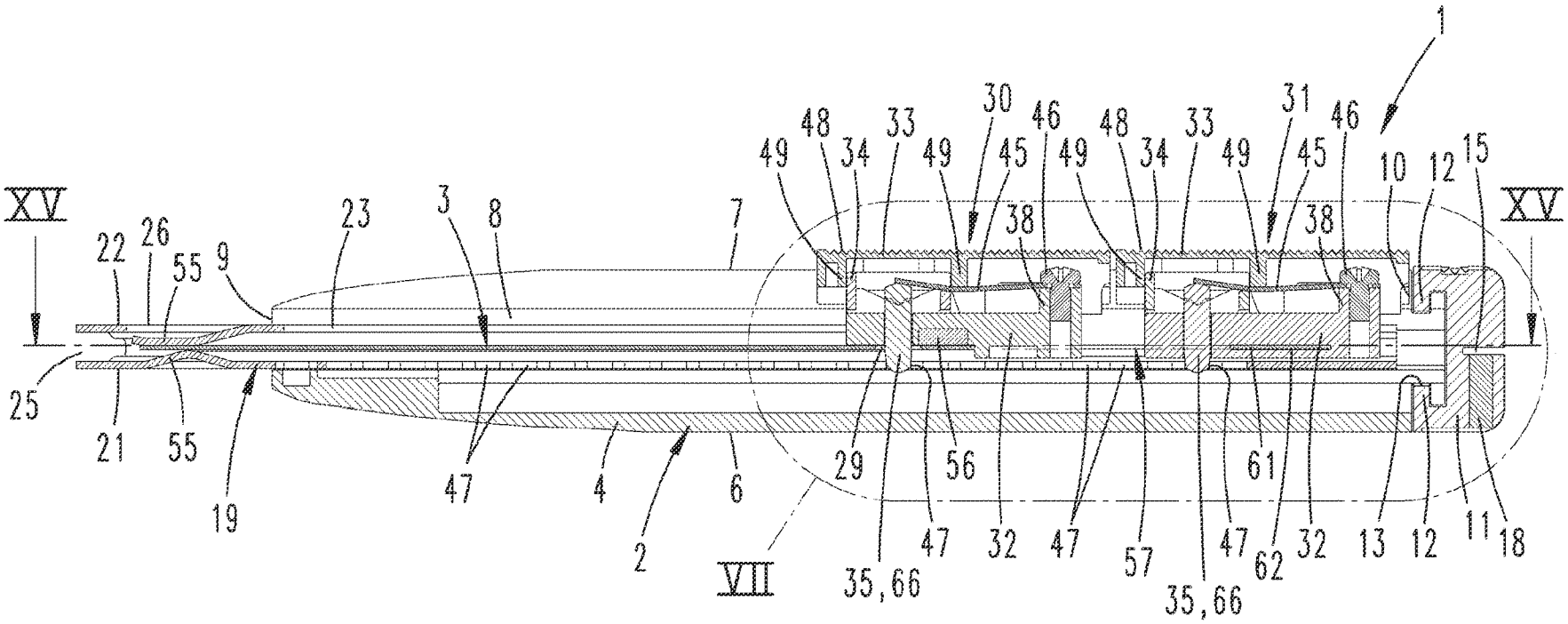
FIG. 6 shows a longitudinal section along the line VI-VI in FIG. 2.
Figure 1:
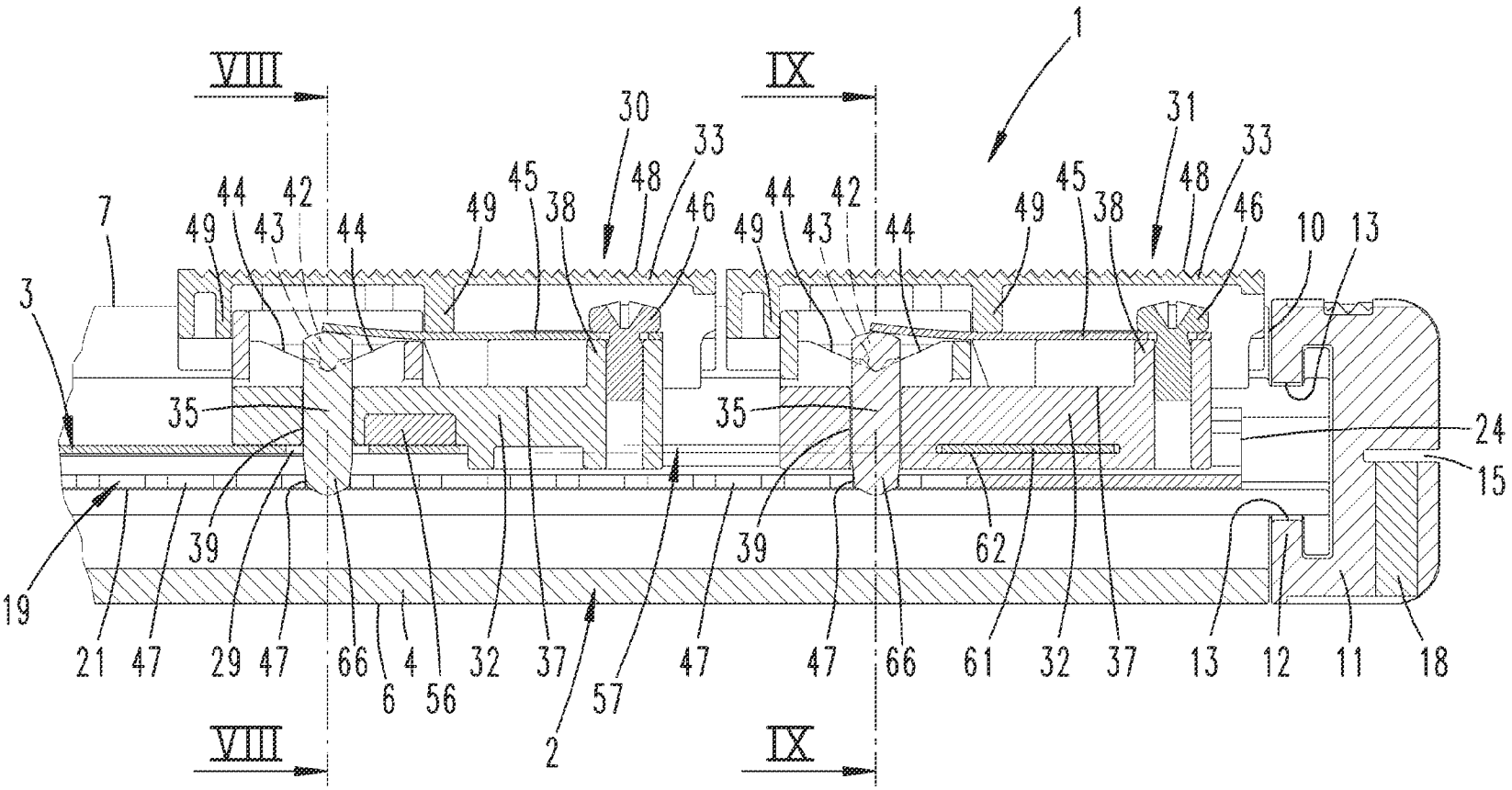

A knife 1 in the form of a so-called cutter knife is initially described with reference to the illustration in FIG. 1, wherein the illustrations in FIGS. 1 to 29 show a first embodiment.

The knife 1 initially and essentially comprises a knife handle 2 and a blade 3 that may be realized in the form of a so-called segmental blade.

The blade 3 can be displaced relative to the knife handle 2 in a sliding manner, namely in the longitudinal direction L of the knife handle 2. This results in an extending direction A and a retracting direction E of the blade 3.

The knife handle 2 initially has a housing 4 that consists, for example, of a hard plastic and may be realized, for example, in the form of an injection molded plastic part. The housing 4 may alternatively also be a metal housing that consists, for example, of a zinc pressure die casting.

Figure 8:
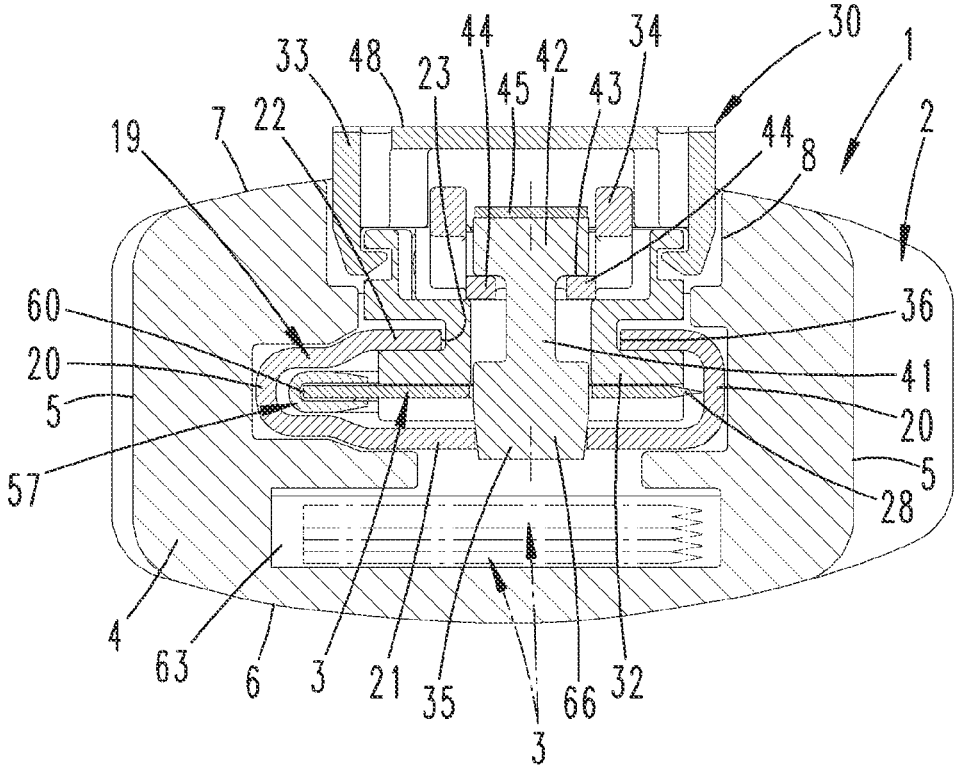
FIG. 8 shows a section along the line VIII-VIII in FIG. 7.

With respect to the longitudinal direction L, the housing 4 has two narrow housing sides 5, which lie opposite of one another in a cross section, e.g. according to the illustration in FIG. 8, as well as a housing bottom 6 that connects these narrow housing sides 5 to one another. A housing top 7 is formed opposite of the housing bottom 6 and contains a slot opening 8, which extends centrally over the entire length of the housing top 7 in the longitudinal direction L. The housing 4 furthermore has a front opening 9 and a rear opening 10. The ends of the slot opening 8 lead into these openings 9 and 10.

In the normal usage state of the knife 1, the rear opening 10 is closed by means of a closing cap 11. This closing cap 11 is connected to the housing 4 in a form-fitted manner in the usage position. For this purpose, a form-fitted guide is provided in the exemplary embodiment shown, wherein the closing cap 11 has guide webs 12, which with respect to a cross section through the closing cap 11 perpendicular to a potential displacement direction of the closing cap 11 face the housing top 7 and the housing bottom 6 and engage into corresponding guide grooves 13 of the housing 4 in the region of the housing top 7 and the housing bottom 6.

In this way, the closing cap 11 can be displaced transverse to the longitudinal direction L in a sliding and guided manner.

The sliding displaceability of the closing cap 11 in the attachment direction is limited by means of a stop. For this purpose, a stop 14 is formed on the housing 4 in the corresponding section of the narrow housing side 5. The closing cap 11 can be freely displaced opposite to the attachment direction in order to allow a complete removal of the closing cap 11 from the housing 4.

The closing cap 11 has a groove 15 that is exposed toward the outside. When the closing cap 11 is arranged on the knife handle 2, this groove is arranged on the cap such that it faces away from the slot opening 8 and essentially extends in the same direction as the guide webs 12 of the closing cap 11 and therefore preferably transverse to the longitudinal direction L.

In a cross section, the groove 15 forms an essentially U-shaped receptacle. This receptacle can be used for snapping off a blade segment 16 from the tip of the blade 3 along a predetermined breaking line 17 when the closing cap 11 is removed.

A magnet 18 is provided in association with the groove 15 and, if applicable, acts upon a blade segment 16 located in the groove 15. This magnet may be recessed into the preferred plastic material of the closing cap 11 and associated, in particular, with a groove surface that in a cross section defines a U-limb of the groove 15. This magnet may be realized in the form of a permanent magnet.

In this way, a blade segment 16 that was snapped off the blade 3 with the aid of the closing cap 11 is securely retained in the groove 15 by the magnet.

The knife handle 2 furthermore has a displacement receptacle 19 that preferably is made of a metallic material. This displacement receptacle may be realized in the form of a bent sheet metal part as shown. Analogous to the housing 4, the displacement receptacle is also realized in an elongate manner in the longitudinal direction L and has two narrow receptacle sides 20, which in a cross section lie opposite of one another, and a receptacle bottom 21 that connects the narrow receptacle sides 20.

A receptacle top 22 is formed opposite of the receptacle bottom 21. This receptacle top also has a slot opening 23 that centrally extends in the longitudinal direction L, wherein said slot opening starts at a rear opening 24 and extends in the longitudinal direction L toward a front opening 25 of the displacement receptacle 19, however, such that an essentially complete front section 26 of the receptacle top 22 remains.

The displacement receptacle 19 is retained in the housing 4 underneath the slot opening 8 in a receptacle 27, the cross section of which is adapted to the displacement receptacle 19. In this retaining position, the slot opening 23 of the displacement receptacle 19 is oriented upward in the direction of the slot opening 8 of the housing 4. The rear end with the opening 24 may in this case essentially extend in the plane that is formed by the rear opening 10 of the housing 4 and extends perpendicular to the extending and retracting directions A, E.

On the front side, the displacement receptacle 19 freely extends beyond the front opening 9 of the housing 4, namely by about a length that is defined by the essentially closed section 26 of the receptacle top 22.

The blade 3 is initially accommodated in the essentially U-shaped receptacle contour of the displacement receptacle 19, which in a cross section extends transverse to the longitudinal direction L, such that it can be respectively displaced in the extending direction A and the retracting direction E in a sliding manner. In the usage position of the knife 1, at least the blade segment 16 on the side of the tip is displaced into a position, in which it freely protrudes beyond the outer edge of the displacement receptacle 19 on the side of the tip, which points in the extending direction A.

The blade 3 is altogether realized in a sheet-like manner with longitudinal outer edges and narrow outer edges, wherein one longitudinal outer edge of the blade 3 forms the cutting edge 28.

In this case, the broad side faces of the blade 3 point in the direction of the housing top 7 and the housing bottom 6.

The blade 3 is furthermore divided into multiple trapezoidal blade segments 16 that are arranged behind one another in a row in the longitudinal direction L, wherein said blade segments 16 initially are connected to one another by means of predetermined breaking lines 17. For example, ten, eleven or up to fifteen blade segments 16 of this type may be thusly predefined. The cutting process can be carried out by using only the respective exposed blade segment 16 on the front side, as well as by using all exposed blade segments 16, i.e. multiple segments protruding beyond the front end.

A bore-like blade opening 29 is formed in the rear end of the blade 3 in order to retain the blade 3 on a blade displacement carriage 30 in a form-fitted manner.

The blade displacement carriage 30, as well as a reinforcing part displacement carriage 31 described below, essentially consists of a carriage part 32, an actuating part 33 and a wedge carriage part 34, as well as a catch part 35.

The carriage part 32 is retained on the displacement receptacle 19 such that it can be displaced in a sliding manner in the longitudinal direction L. For this purpose, outer receptacle grooves 36 of the carriage part 32, which extend in the longitudinal direction L, take hold of the facing outer edges of the slot openings 23 of the displacement receptacle. With respect to a cross section, a portion of the carriage part 32 may extend within the U-opening of the displacement receptacle 19 and a—larger—portion of the carriage part 32 may essentially extend in the region of the slot opening 8 of the housing 4.

The carriage part 32 is realized in a box-like manner in the direction pointing toward the housing top 7. The wedge carriage part 34 lies on the box bottom of the carriage part 32 such that it can be displaced in a sliding manner in the longitudinal direction L, wherein said wedge carriage part is flanked on both sides and optionally—at least partially—guided in the longitudinal direction L by means of box walls 38 of the carriage part 32.

A rectangular opening 39, which in a horizontal projection has an essentially elongate shape, furthermore is formed in the box bottom 37. The corresponding longitudinal side referred to a horizontal projection of the opening is directed transverse to the longitudinal direction L in this case.

The catch part 35, which is realized in the form of a catch pin 66 in the first embodiment, extends through this opening 39, wherein the cross section of its pin body is essentially adapted to the opening area of the opening 39.

As a result of this design, the catch part 35 is retained in the carriage part 32 such that it is non-rotatable about an axis extending perpendicular to the longitudinal direction L and perpendicular to the housing bottom 6, but can be linearly displaced along this axis.

In the first embodiment, the catch part 35 also penetrates the wedge carriage part 34 in the region of a bottom opening 40, particularly in the region of a waist section 41. In this case, widened pin sections, which are essentially adapted to the opening area of the opening 39 in the box bottom 37, remain at the ends of the waist section 41 on both sides.

The pin section 42 engaging into an interior region of the wedge carriage part 34 forms exposed application surfaces 43 on its underside, i.e. in the direction of the housing bottom 6, wherein said application surfaces serve for interacting with wedge surfaces 44 of the wedge carriage part 34.

The wedge surfaces 44 are referred to the longitudinal direction L provided to both sides of the opening 40 extending through the wedge carriage part 34. Two wedge surfaces 44, which extend opposite to one another in the longitudinal direction L, are furthermore provided on each side and meet in a valley centrally of the extent of the wedge carriage part 34 in the longitudinal direction L. In an engaged basic position, the application surfaces 43 of the catch part 35 abut on the wedge surfaces 44 in this valley (compare to FIG. 17).

The wedge surfaces 44 accordingly ascend from this valley in the extending direction A and in the retracting direction E by an angle of about 10 to 20 degrees.

The catch part 35 may be spring-loaded in the direction of the receptacle bottom 21 by means of a spring 45 in the form of a leaf spring.

According to the illustrations, the spring 45 may be fastened on the carriage part 32 in an abutting manner by using a fastening element 46, e.g. in the form of a screw (compare to FIG. 17).

The catch part 35 engages into a catch opening 47 in the receptacle bottom 21 through the opening 39 of the carriage part 32. The displacement carriage 30, 31 is fixed in the longitudinal direction L in this catching position.

The receptacle bottom 21 has multiple catch openings 47, which are realized identically with respect to their opening area and arranged behind one another in the longitudinal direction L. The opening cross section of these catch openings essentially corresponds to that of the opening 39 in the carriage part 32 and accordingly is adapted to the cross-sectional design of the catch part 35, particularly of the catch pin 66.

The catch openings 47 may be connected to one another as shown by means of waist-like, slot-shaped openings, the opening area of which is correspondingly reduced in comparison with the catch openings 47.

It is imperative to disengage the catch engagement between the catch part 35 and the catch opening 47 in order to allow a sliding displacement of the carriage part 32. For this purpose, it is preferred to act upon the wedge carriage part 34 in such a way that it is displaced in a sliding manner relative to the carriage part 32 in the longitudinal direction L. This is realized by using the actuating part 33, an actuating surface 48 of which is exposed in the slot opening 8 of the housing.

The actuating part 33 has on its underside driving projections 49 that point in the direction of the carriage part 32 and referred to the longitudinal direction L respectively come in contact with associated surfaces of the wedge carriage part 34. The wedge carriage part 34 accordingly is captured between these driving projections 49 in the longitudinal direction L.

During a sliding displacement of the actuating part 33 in the extending direction A, the rear driving projection 49 referred to the extending direction A causes the wedge carriage part 34 to be correspondingly dragged along. The catch part 35 is pulled out of the catch opening 47 in a direction extending perpendicular to the longitudinal direction L by the rear wedge surfaces 44 referred to the extending direction A (compare to FIG. 19). This relative sliding displacement of the actuating part 33 and the wedge carriage part 34 takes place until the section of the carriage part 34 interacting with the driving projection 49 abuts on the lifted catch part 35, whereupon the carriage part 32 is now also dragged along by means of the catch part 35 during a corresponding further sliding displacement of the actuating part 33 in the extending direction A.

Figure 24:
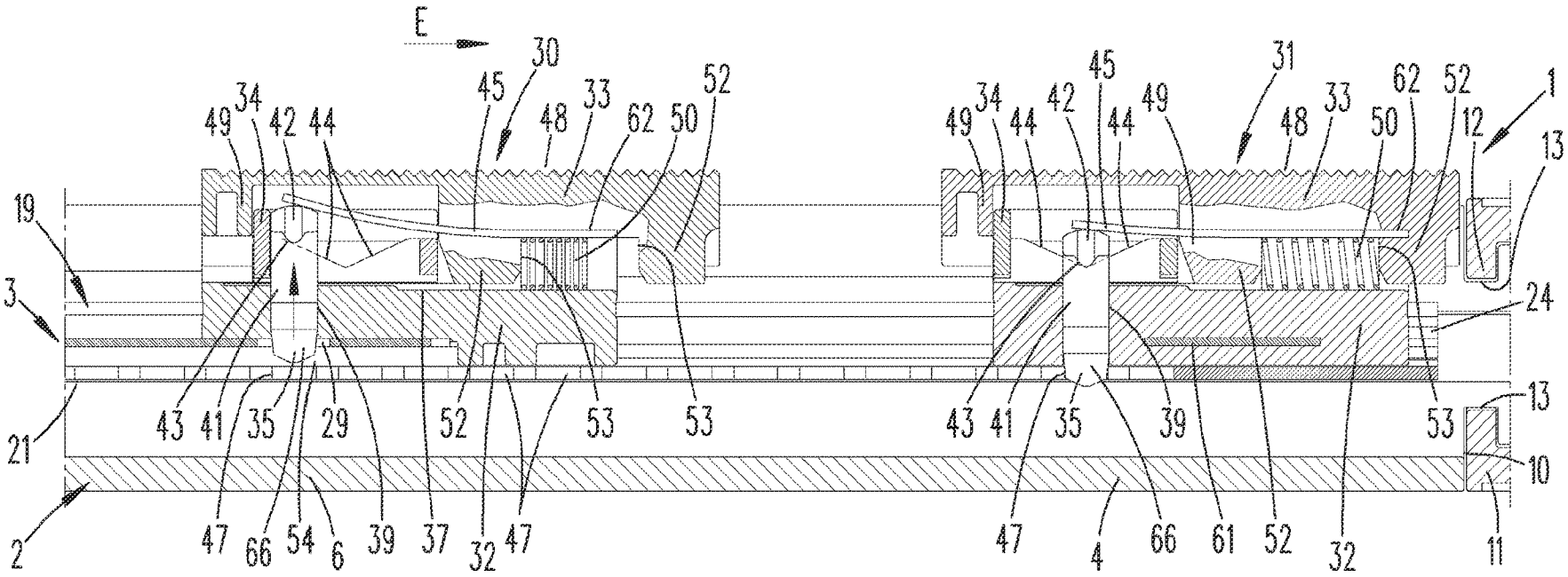
FIG. 24 shows a section according to FIG. 19, but after disengaging the catching position in order to displace the blade displacement carriage in the retracting direction.
Figure 25:
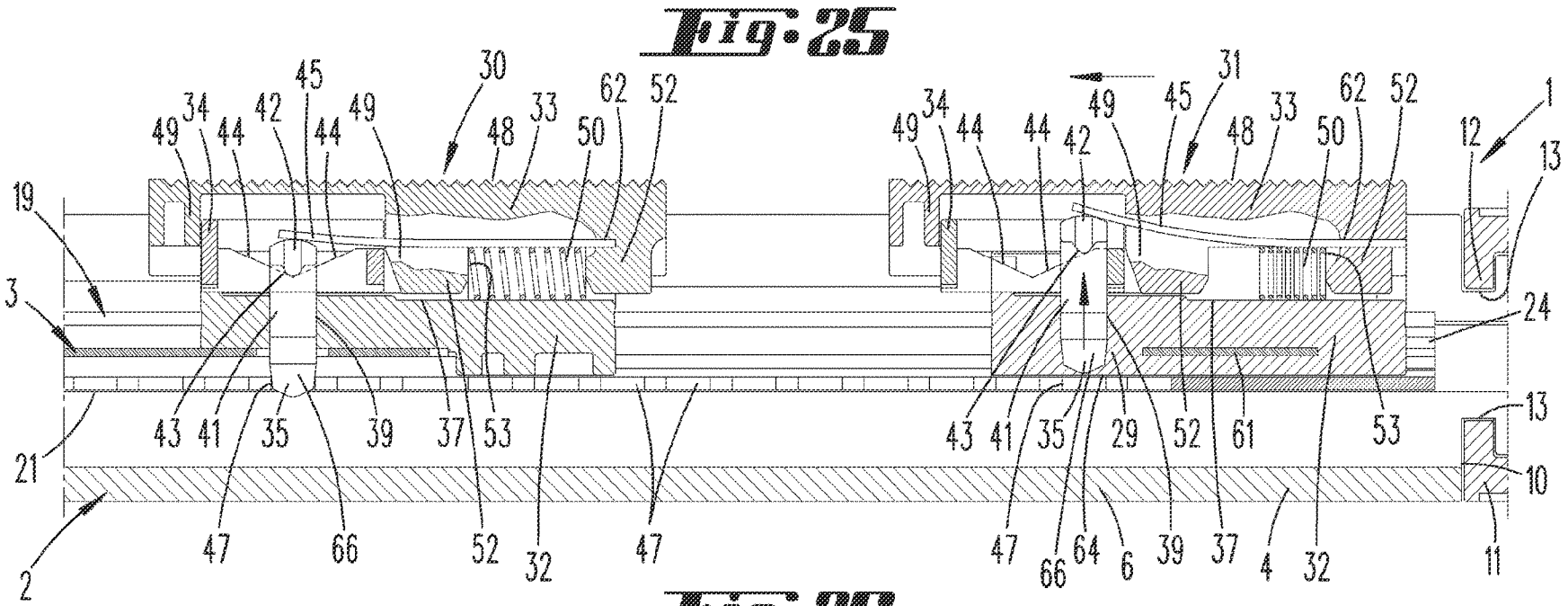
FIG. 25 shows an illustration corresponding to FIG. 19 and concerning the catch disengagement and sliding displacement of a reinforcing part displacement carriage in the extending direction.
Figure 26:
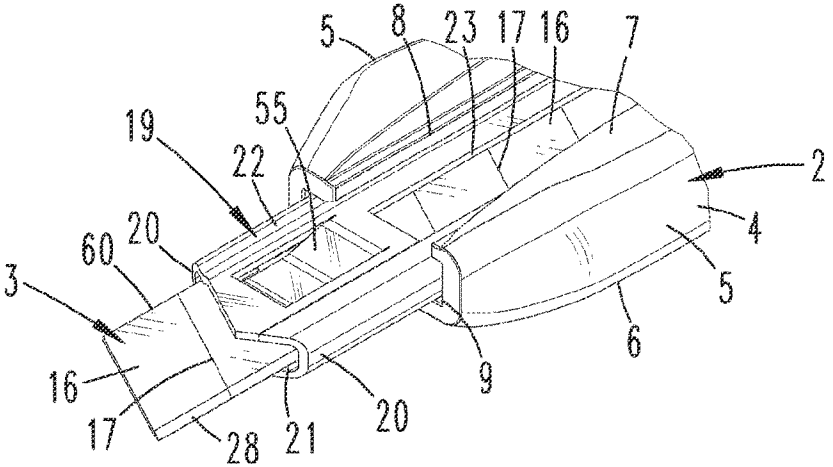
FIG. 26 shows a perspective view of a front knife end with partially extended blade.
Figure 27:
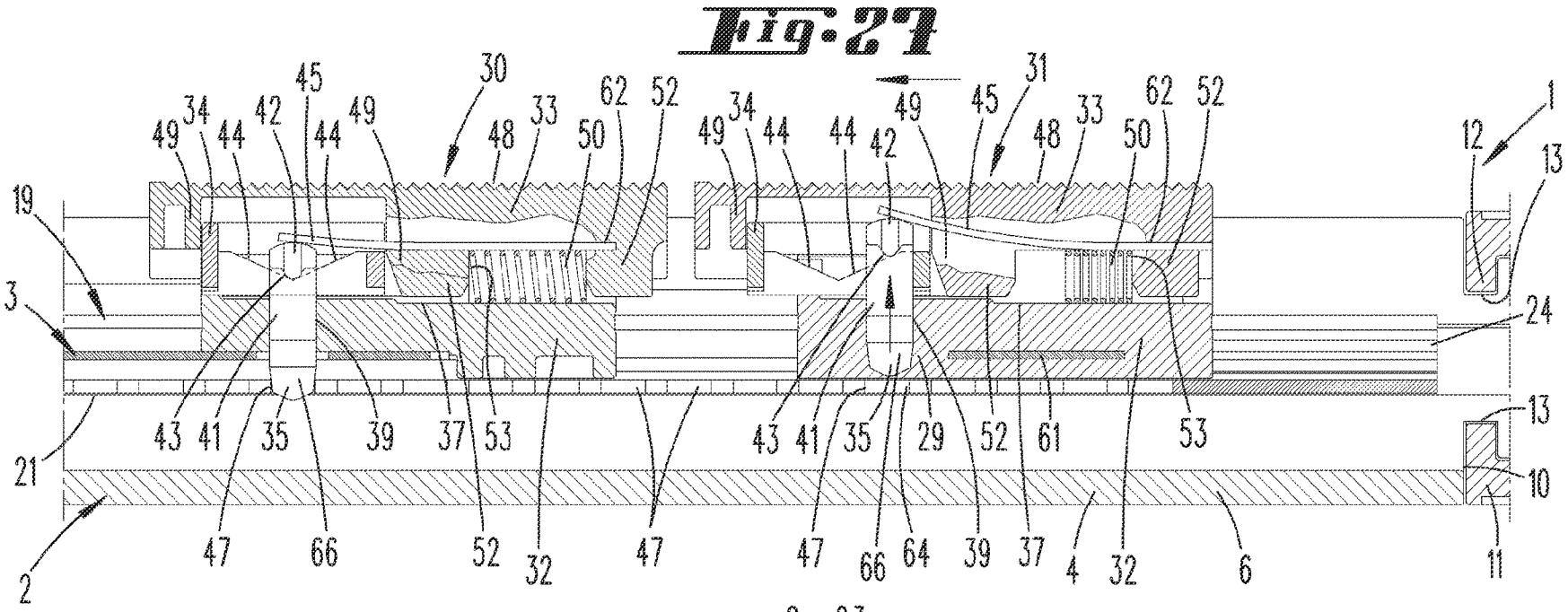
FIG. 27 shows a follow-up illustration to FIG. 25 after a sliding displacement of the reinforcing part displacement carriage in the extending direction.
Figure 28:
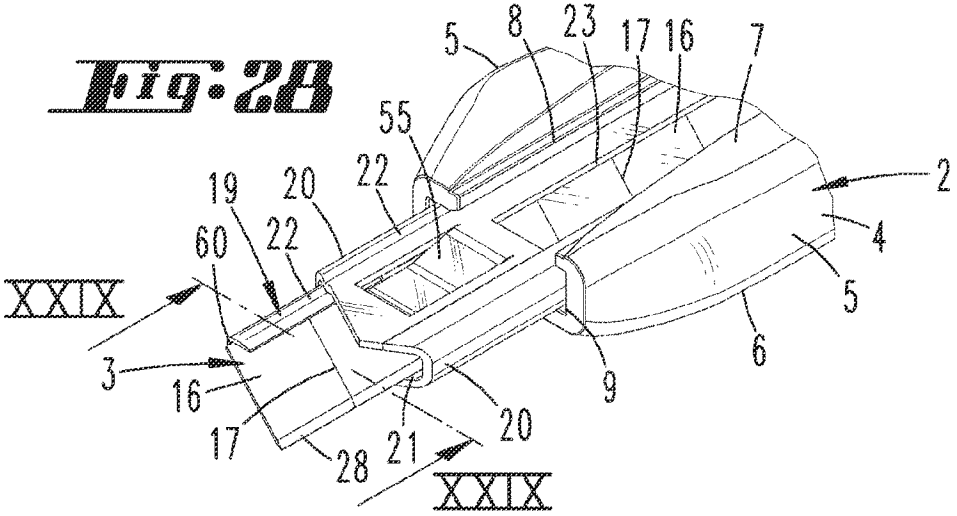
FIG. 28 shows an illustration corresponding to FIG. 26 with extended reinforcing part.
Figure 29:
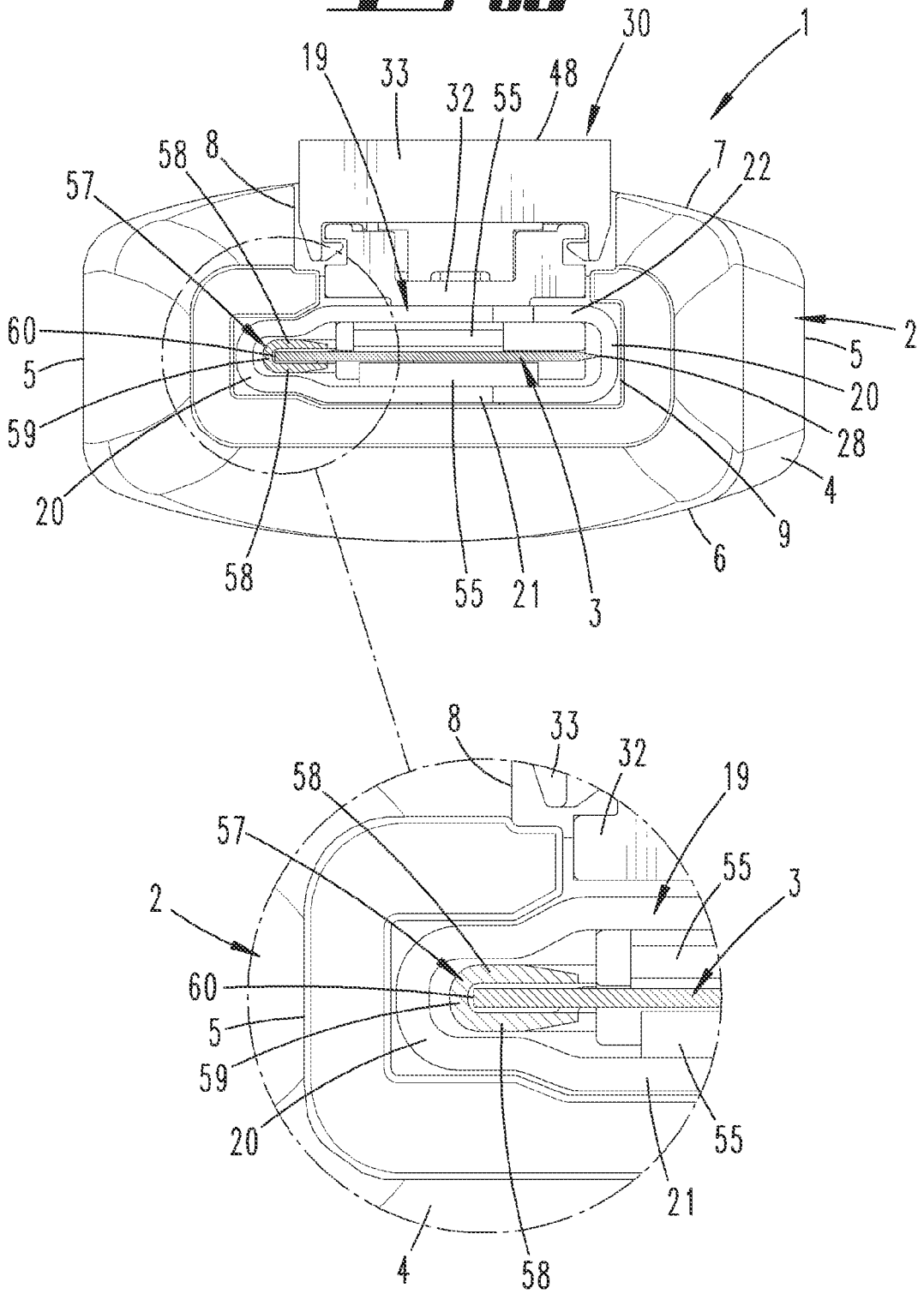
FIG. 29 shows a section along the line XXIX-XXIX in FIG. 28 including a corresponding detailed enlargement.
Figure 30:
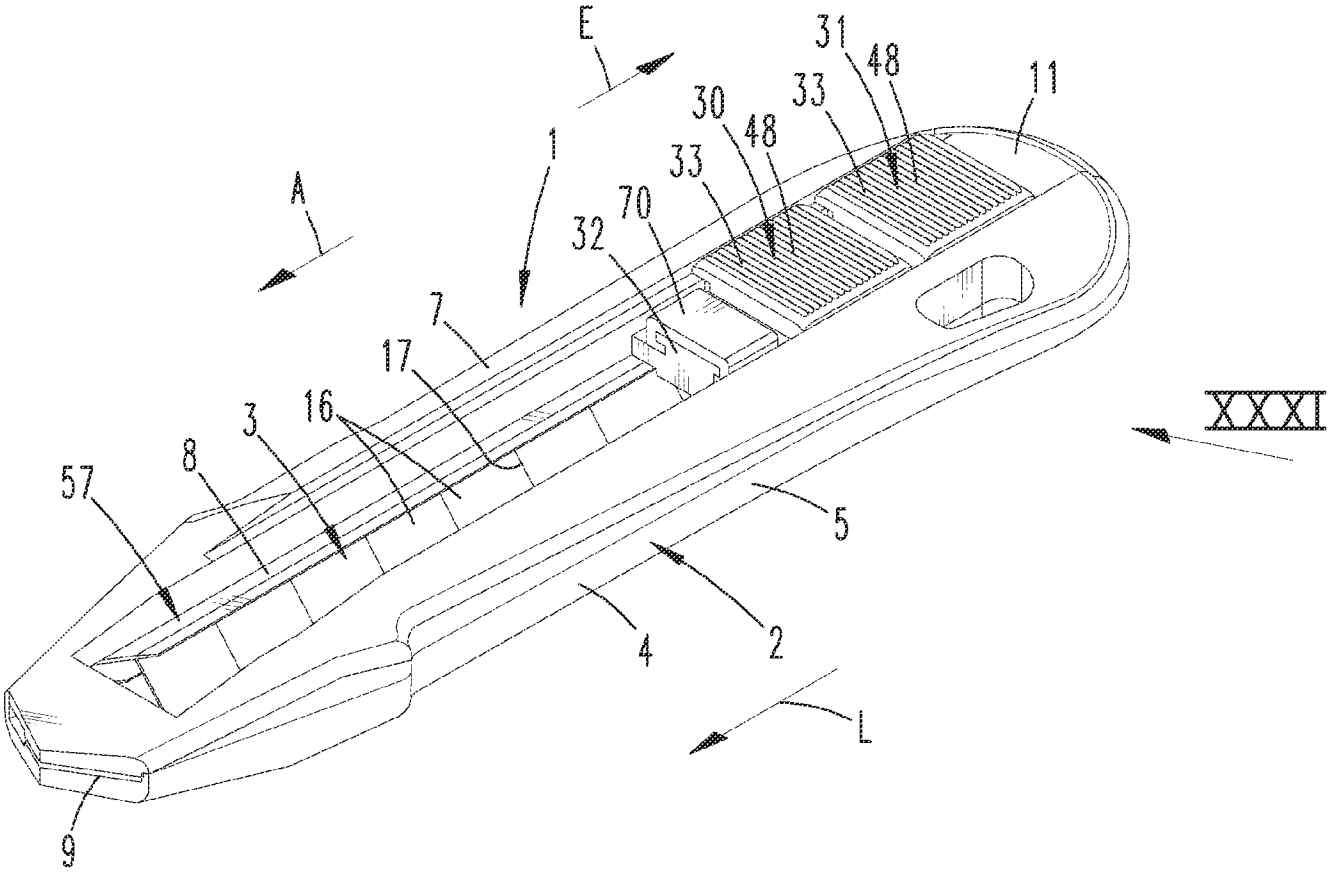
FIG. 30 shows an illustration corresponding to FIG. 1 and concerning a second embodiment.
Figure 31:
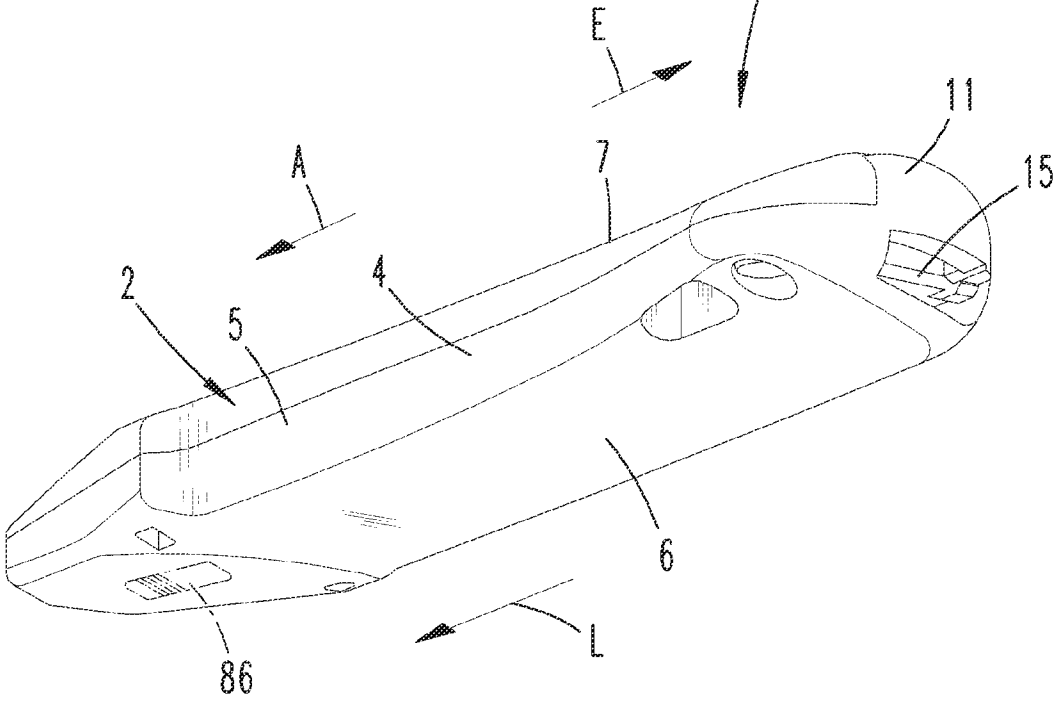
FIG. 31 shows a perspective bottom view of the knife in accordance with the arrow XXXI in FIG. 30.
Figure 32:
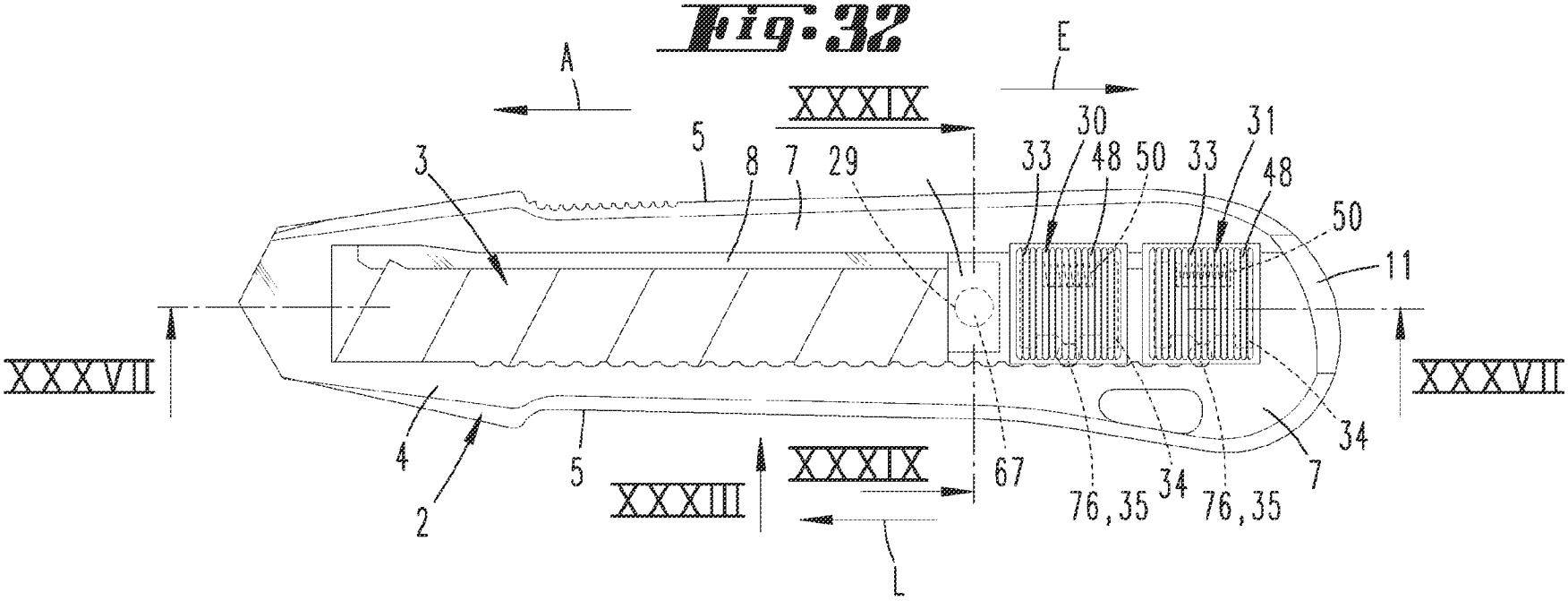
FIG. 32 shows a top view of the knife according to the second embodiment.
Figure 33:
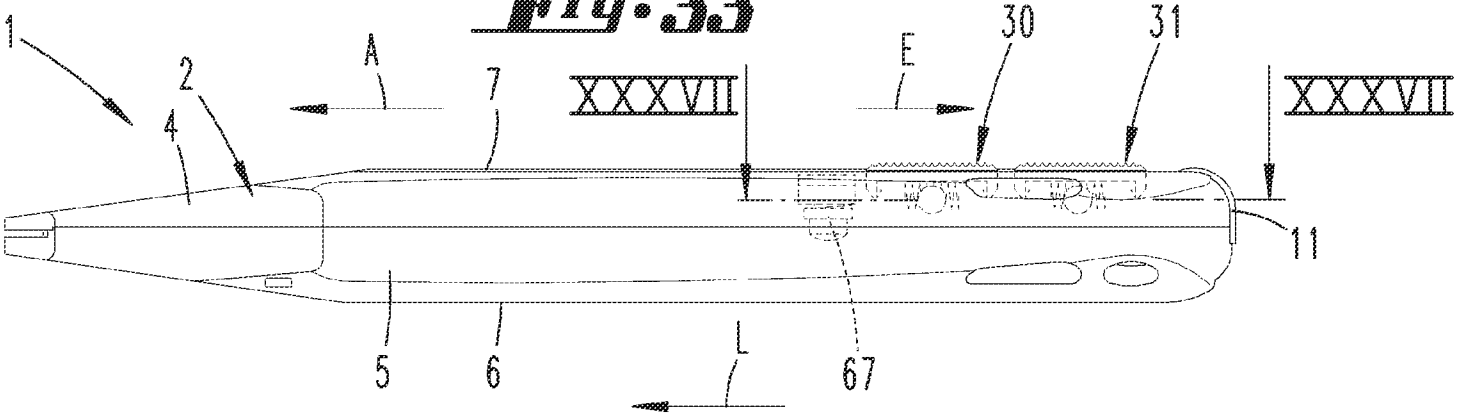
FIG. 33 shows a side view of the knife.

An analogous sliding displacement takes place in the opposite direction, namely in the retracting direction E, wherein the rear driving projection 49 of the actuating part 43 referred to the retracting direction E interacts with the wedge carriage part 34 in this case and the rear wedge surfaces 44 referred to the retracting direction E lift or pull the catch part 35 out of the catch opening 47 (compare to FIG. 24).

Accordingly, only an intentional sliding displacement of the respective displacement carriage 30, 31 is required for realizing the disengagement of the catch mechanism and the sliding displacement in the longitudinal direction L.

Once the actuating part 33 is no longer acted upon in the sliding direction in order to thereby complete the sliding displacement of the displacement carriage 30, 31, the respective wedge carriage part 34 with the actuating part 33 returns into a starting position that preferably corresponds to the catching position.

For this purpose, the wedge carriage part 34 is spring-loaded in the direction of the basic position by means of a spring 50, which is realized in the form of a cylindrical pressure spring in this case. This spring 50 lies in a spring receptacle 51, which is formed in the carriage part 32 on the box bottom 37, and is in a (neutral) basic position optionally supported on associated wall sections of the spring receptacle 51 on both ends.

The contact surfaces for the spring 50 on the carriage are respectively penetrated by projections 52 of the actuating part 33, wherein at least one projection 52 may also be directly formed by a driving projection 49. The projections 52 have supporting surfaces 53 that are directed toward one another and come into effect depending on the displacement direction A or E in order to lift off the facing end of the pressure spring accommodated in the spring receptacle 51 from the facing contact surface in the receptacle surface 51. If the spring 50 is realized in the form of a cylindrical compression spring, this spring is accordingly tensioned between a supporting surface 53 of the actuating part 33 and a contact surface of the spring receptacle 51 during a displacement of the actuating part 33 in a displacement direction.

As a result of this design, this single spring 50 causes a return into the starting position during a sliding displacement in the extending direction A, as well as in the retracting direction E.

The above-described functionality for the disengagement, sliding displacement and engagement refers to the blade displacement carriage 30, as well as to the reinforcing part displacement carriage 31.

The catch part 35 of the blade displacement carriage 30 may at the same time penetrate the blade opening 29 such that this blade opening is connected to the blade displacement carriage 30 in a form-fitted manner. In this case, the blade 3 is accommodated on the underside of the carriage part 32 in a receptacle pocket 54 that is open toward the receptacle bottom 21 of the displacement receptacle 19. The catch part 35 also continues to extend through the blade opening 29 in the lifted position of the catch part 35, in which the catch connection is disengaged, such that the form-fitted position is also preserved in the course of a sliding displacement.

The associated end of the blade 3 lies in the receptacle pocket 54 in such a way that its broad side rests on a preferably planar supporting surface 65. This supporting surface 65 is penetrated by the catch part 35.

The receptacle pocket 54 and therefore also the supporting surface 65 is bounded by a contact surface 64, wherein a transverse outer edge of the blade 3, which preferably extends parallel to the predetermined breaking lines 17, can abut on said contact surface. The progression of the contact surface 65 is adapted to that of the transverse outer edge. In a preferred embodiment, the transverse outer edge extends at a distance from the contact surface 65.

In the course of an extension of the blade 3, the free end of the blade 3 pointing in the direction of the displacement receptacle tip is displaced outward through the front opening 25 of the displacement receptacle 19. As a result, the blade 3 is guided in the direction of the blade plane in the region of the top section 26, as well as in the region of the receptacle bottom 21 of the displacement receptacle 19, [text missing] vaulted spring sections 55.

In order to additionally secure the form-fitted retention between the catch part 35 of the carriage and the blade 3, a retaining magnet 56 may furthermore be arranged in the carriage part 32 of the blade displacement carriage 30 in order to interact in a retaining manner with the blade 3 in the receptacle pocket 54 accommodating the blade opening 29. This is particularly advantageous during a blade exchange, in which the blade displacement carriage 30 is after the removal of the closing cap 11 pulled out together with the blade 3 through the rear opening 10 of the housing 4 and the rear opening 24 of the displacement receptacle 19. The inventive arrangement of a magnet that also retains the blade 3 on the carriage part 32 significantly simplifies, in particular, the reinsertion of an optionally new blade 3 together with the blade displacement carriage 30.

The illustrations furthermore show that a reinforcing part displacement carriage 31 may be provided. This reinforcing part displacement carriage can also be displaced in a sliding manner in the longitudinal direction L, i.e. in the extending direction A and in the retracting direction E, in the same displacement receptacle 19. The reinforcing part displacement carriage 31 is arranged behind the blade displacement carriage 30 referred to the extending direction A.

The reinforcing part displacement carriage 31 serves for the intentional linear displacement of a reinforcing part 57, wherein the blade 3, particularly the region of the blade 3 that is extended beyond the front opening 25 of the displacement receptacle 19, is supported on said reinforcing part 57 in the extended position.

For this purpose, the reinforcing part 57 essentially has in a cross section transverse to the longitudinal direction L a U-shape with two U-limbs 58, which extend parallel to one another and are spaced apart from one another, as well as a U-crosspiece that connects the U-limbs. The outer edge 60 of the blade 3, which referred to the broad side lies opposite of the cutting edge 28, is accommodated in the U-opening, namely over a certain length or depth of the U-groove transverse to the longitudinal direction L referred to a cross section, e.g., according to FIG. 9, wherein said length or depth may approximately correspond to one-sixth to one-fourth of the width of the blade 3 transverse to the longitudinal direction L.

The reinforcing part 57 forms a sword-like extension arm 61 on its end that faces the rear region of the housing 4. This extension arm is accommodated in a slot-like receptacle of the carriage part 33 of the reinforcing part displacement carriage 31. In this way, the reinforcing part 57 is connected in a form-fitted manner to the corresponding carriage part 32 and can be displaced in a sliding manner in the longitudinal direction L by this carriage part.

Furthermore, the reinforcing part 57 is guided in the displacement receptacle 19 in an edge region laterally of the carriage parts 32 and in this case extends at least approximately over the entire length of the blade 3 in a completely retracted position of the reinforcing part and blade displacement carriages 30, 31.

When the blade 3 is extended, the reinforcing part displacement carriage 31 can after the disengagement of the catch mechanism likewise be displaced in the extending direction A as needed, particularly if a high bending stress on the blade 3 and therefore the risk of breakage of blade segments 16 is expected in the course of the cutting process, wherein the front end region of the reinforcing part 57, which faces away from the displacement carriage, likewise protrudes beyond the front opening 25 of the displacement receptacle 19 and—apparently—stabilizes the blade 3 by encompassing the outer edge 60 of the blade 3.

However, if a low bendability of the extended section of the blade 3 is by all means useful for the cutting process to be carried out, the reinforcing part displacement carriage 31 can be respectively displaced back in the retracting direction E or remain in the resulting basic position.

The reinforcing part 57 can be displaced relative to the blade 3 in the extending direction A and in the retracting direction E as shown.

Figure 9:
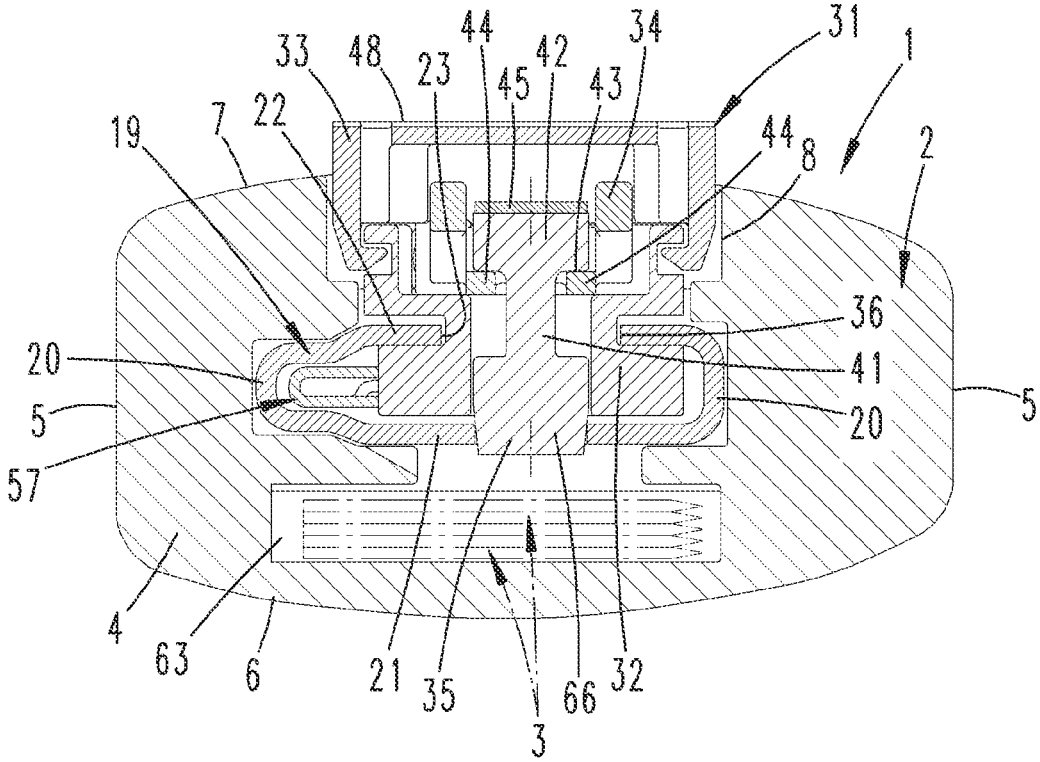
FIG. 9 shows a section along the line IX-IX in FIG. 7.
Figure 10:
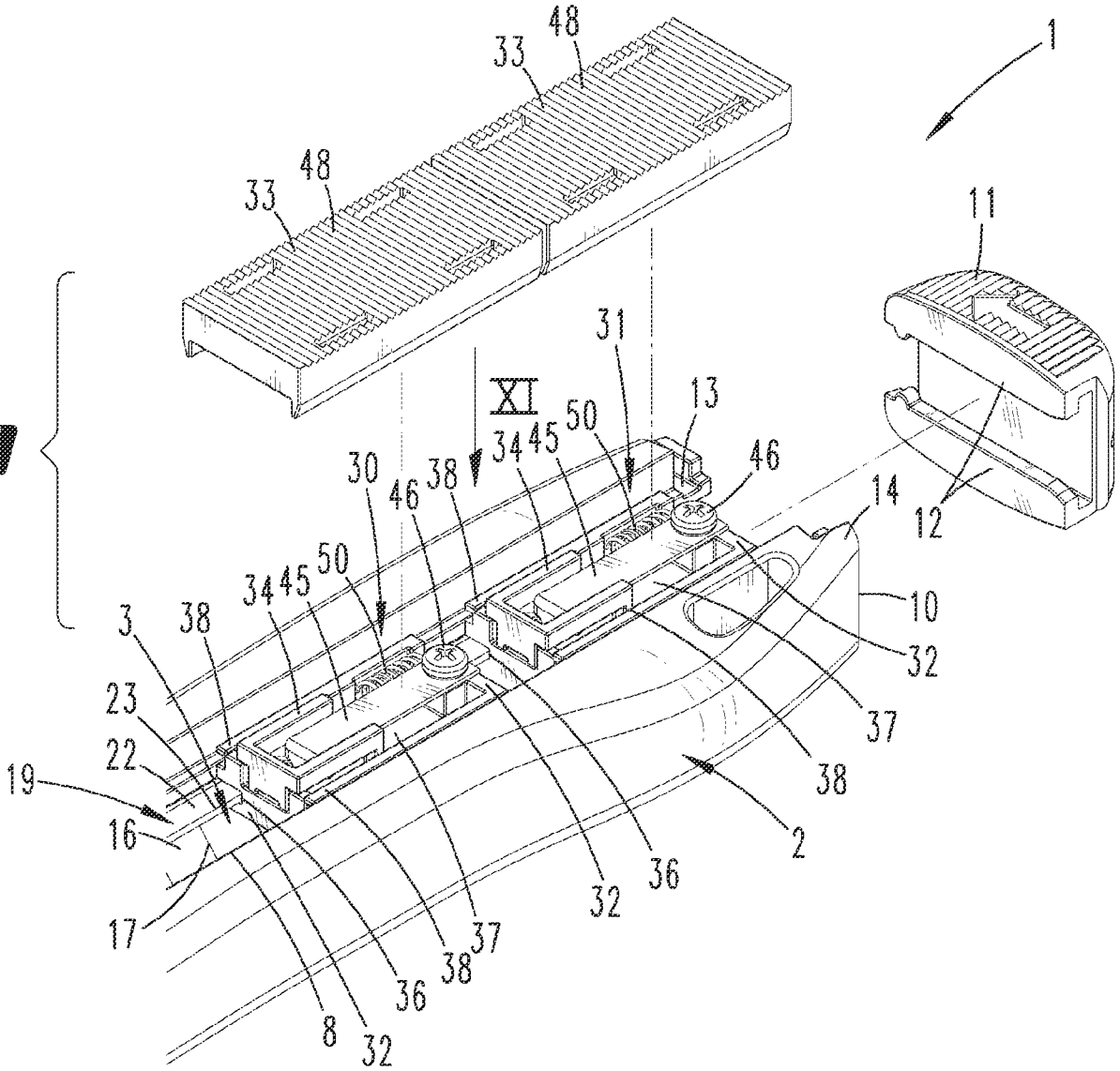
FIG. 10 shows a detailed illustration of a displacement carriage region of the knife in the form of a partially exploded view.
Figure 11:
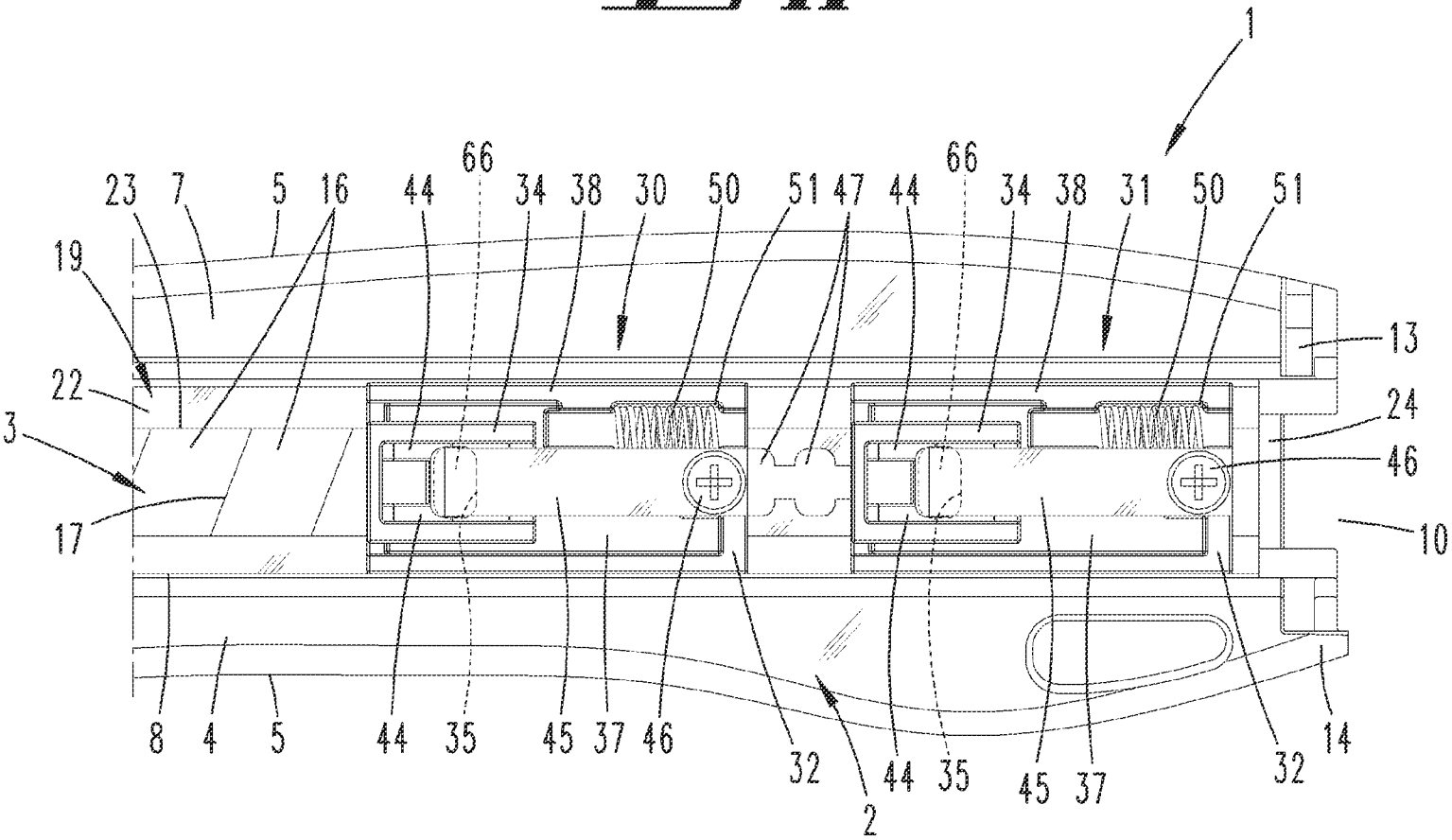
FIG. 11 shows the displacement carriage region in the form of a top view, in which actuating parts of the displacement carriage are removed.
Figure 12:
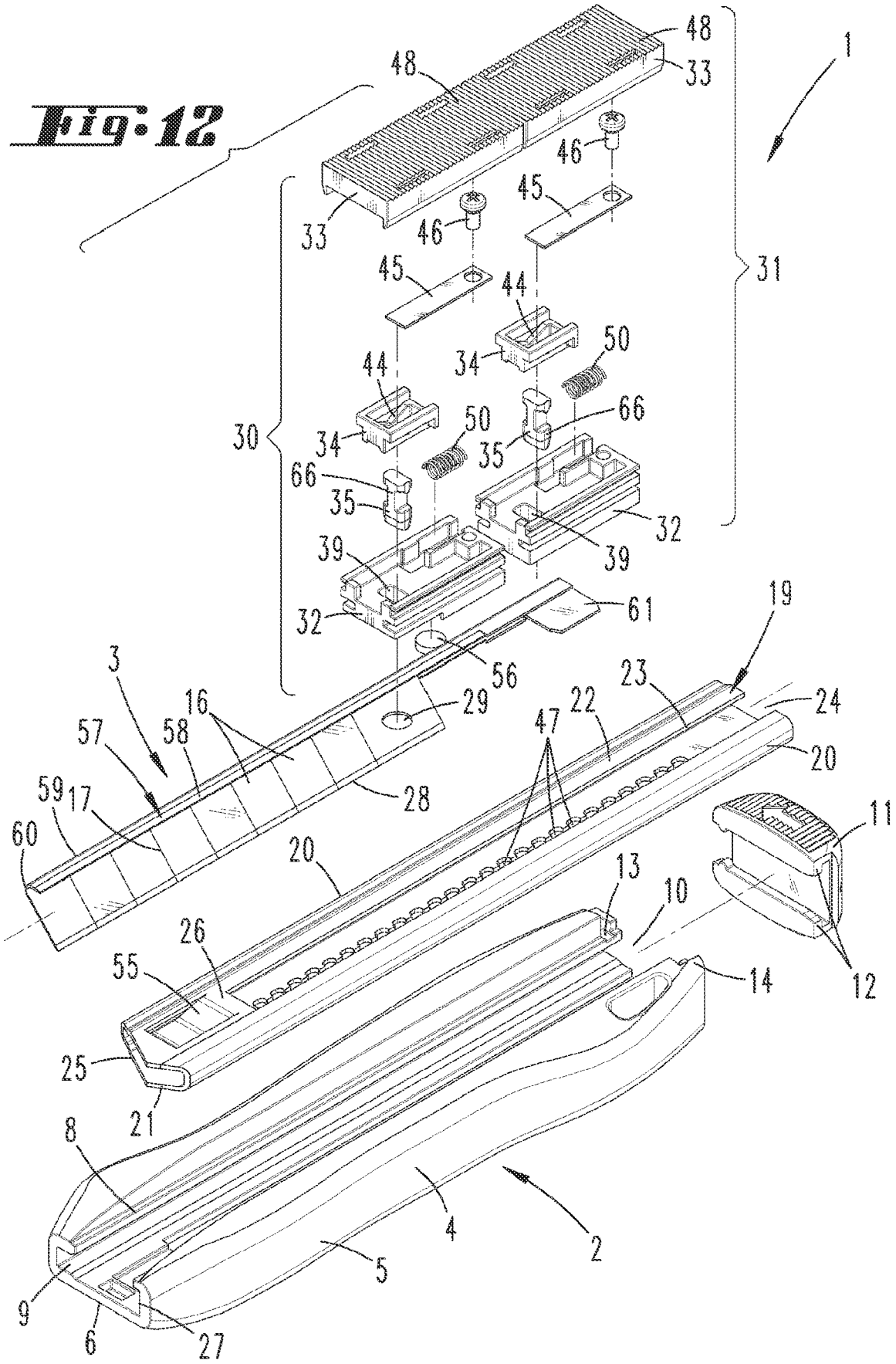
FIG. 12 shows the knife in the form of an exploded perspective view.
Figure 13:
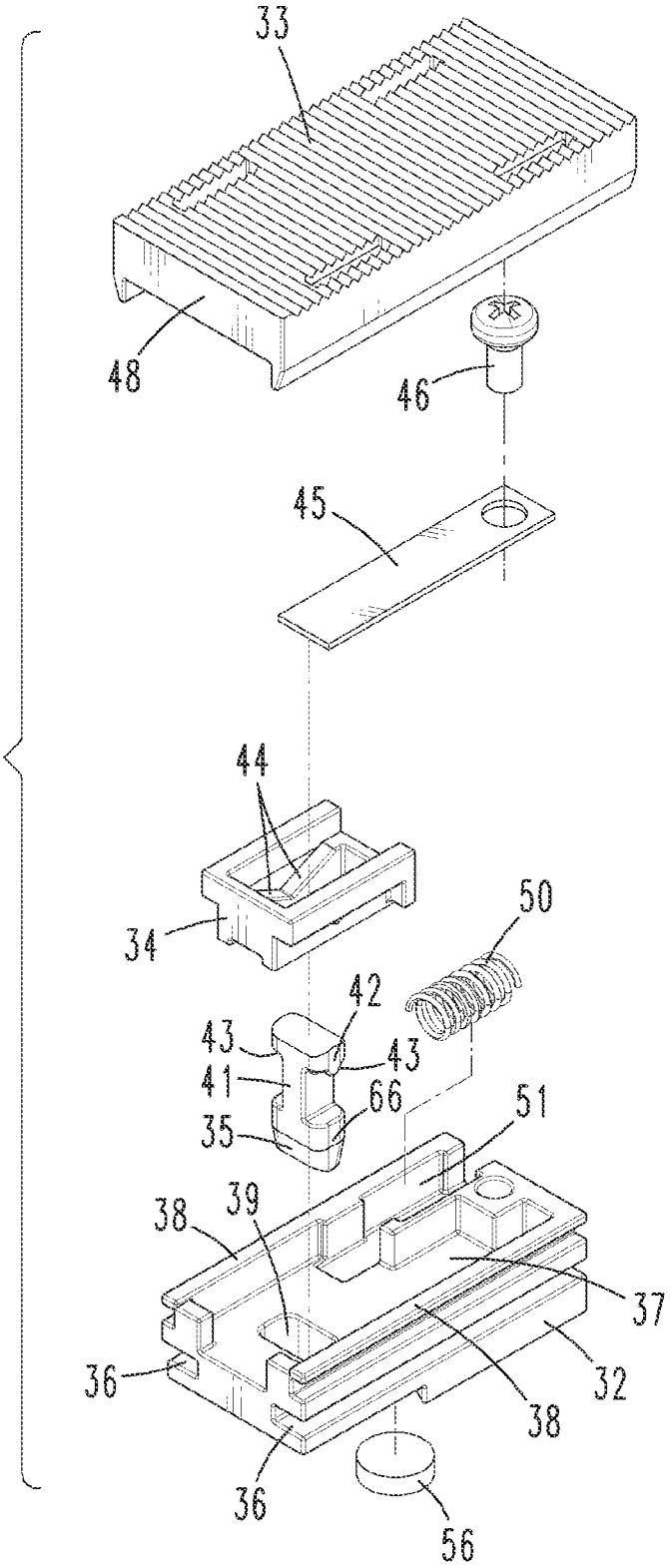
FIG. 13 shows an enlarged exploded perspective view of a displacement carriage.
Figure 14:
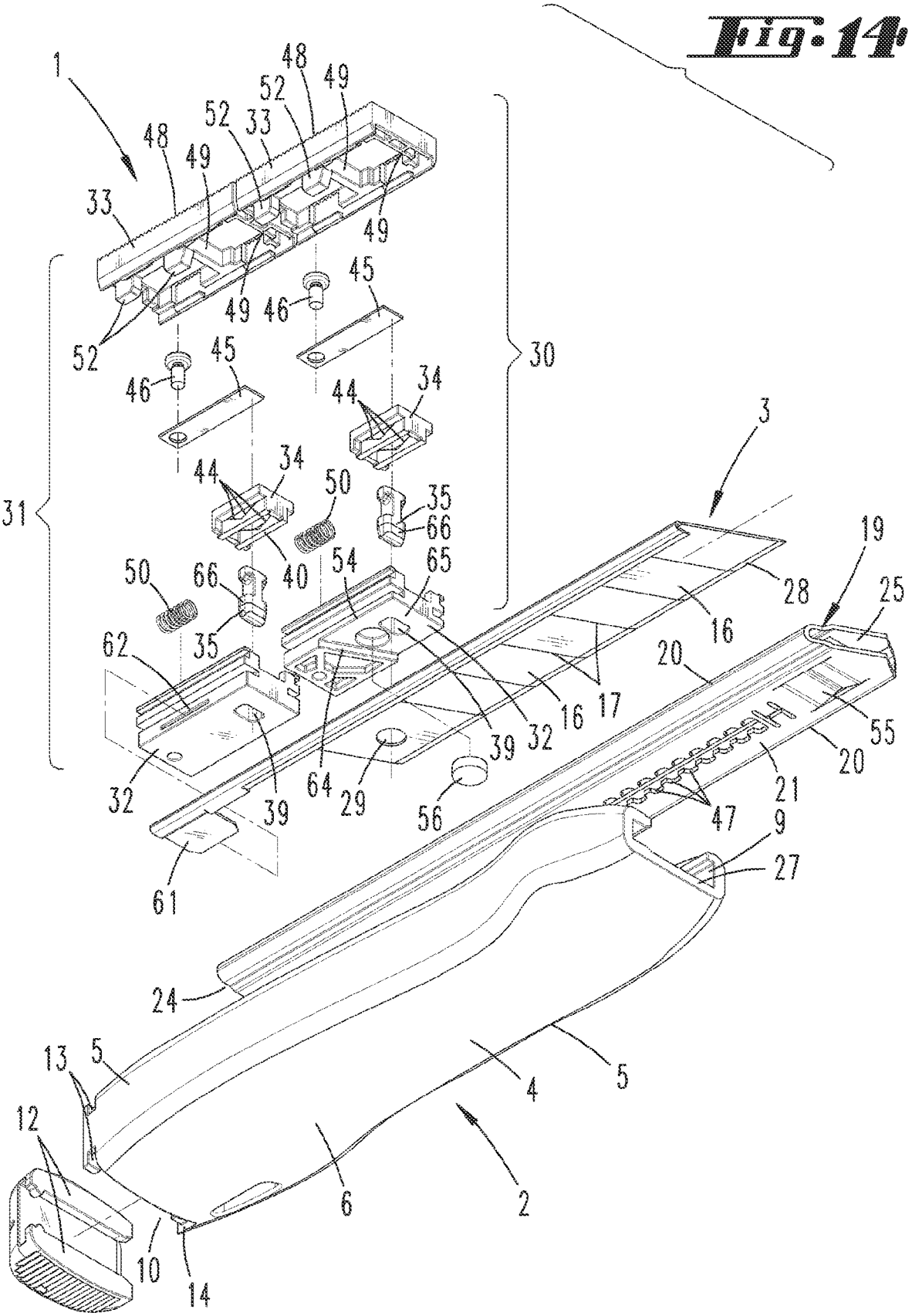
FIG. 14 shows an exploded perspective bottom view of the knife.
Figure 15:
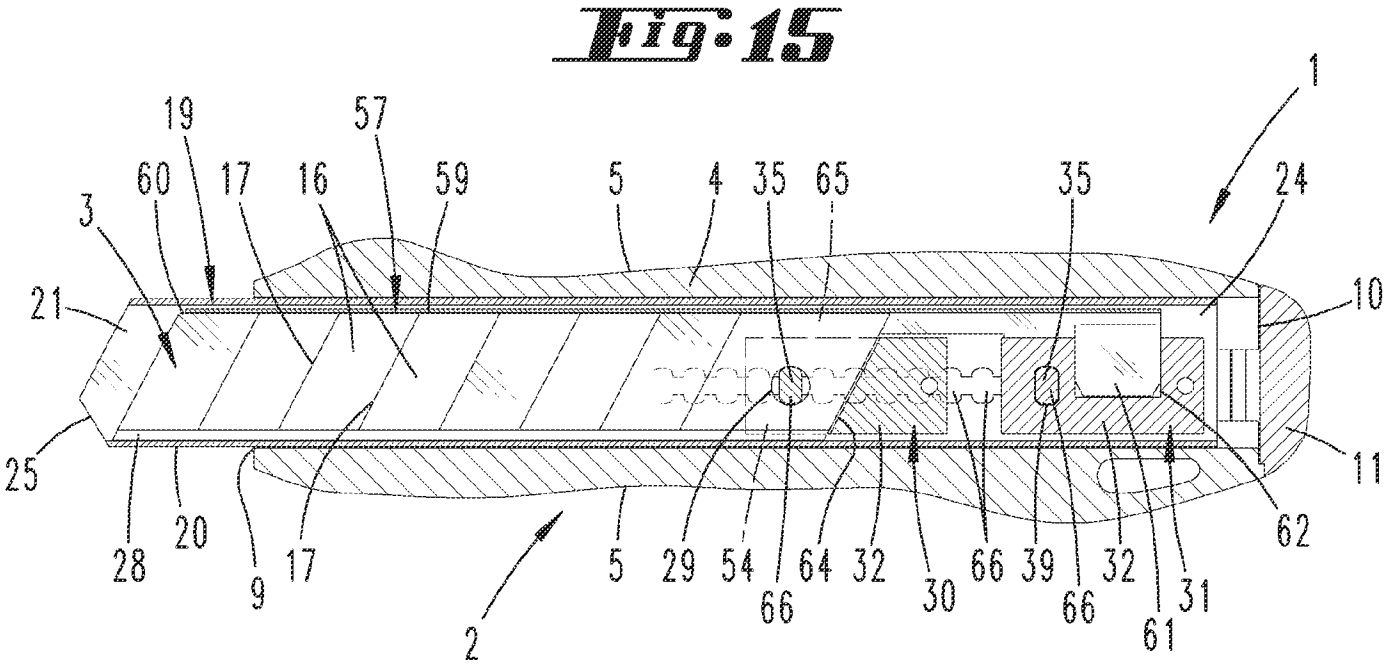
FIG. 15 shows a longitudinal section along the line XV-XV in FIG. 6.
Figure 16:
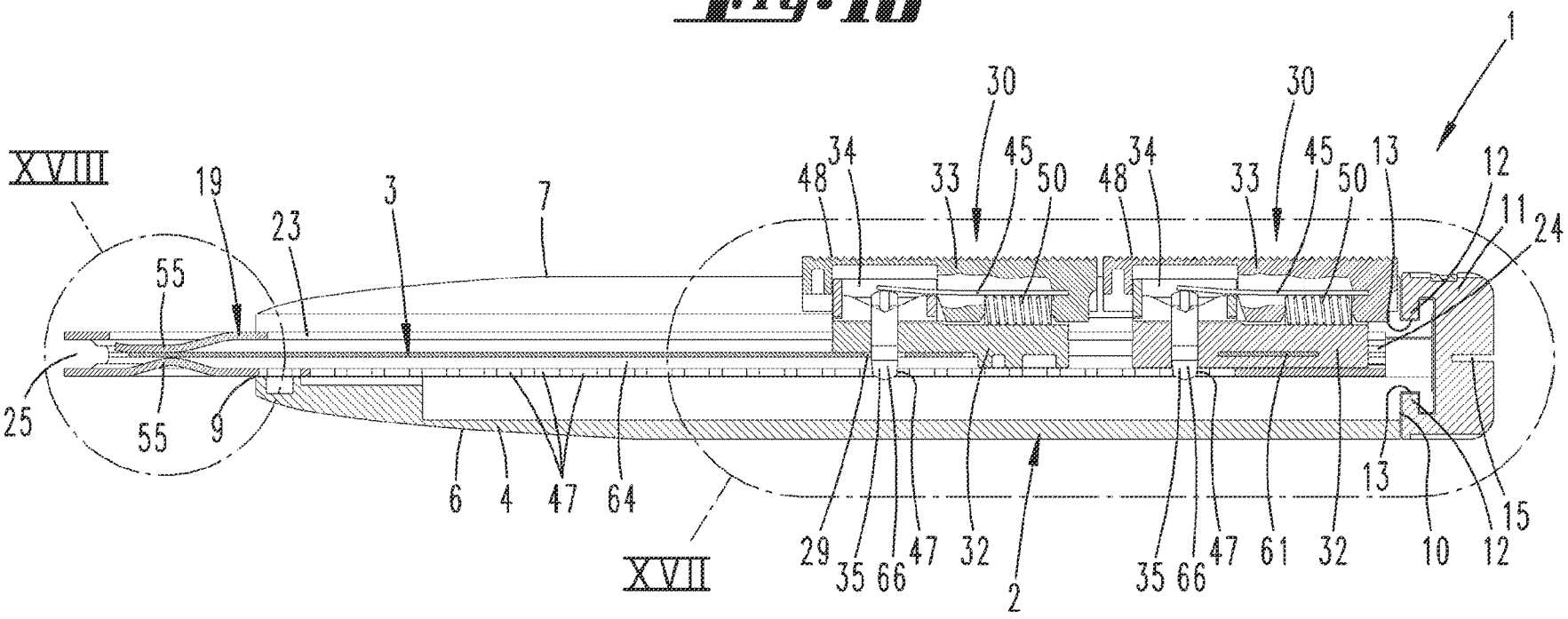
FIG. 16 shows a longitudinal section along the line XVI-XVI in FIG. 2.
Figure 1A:
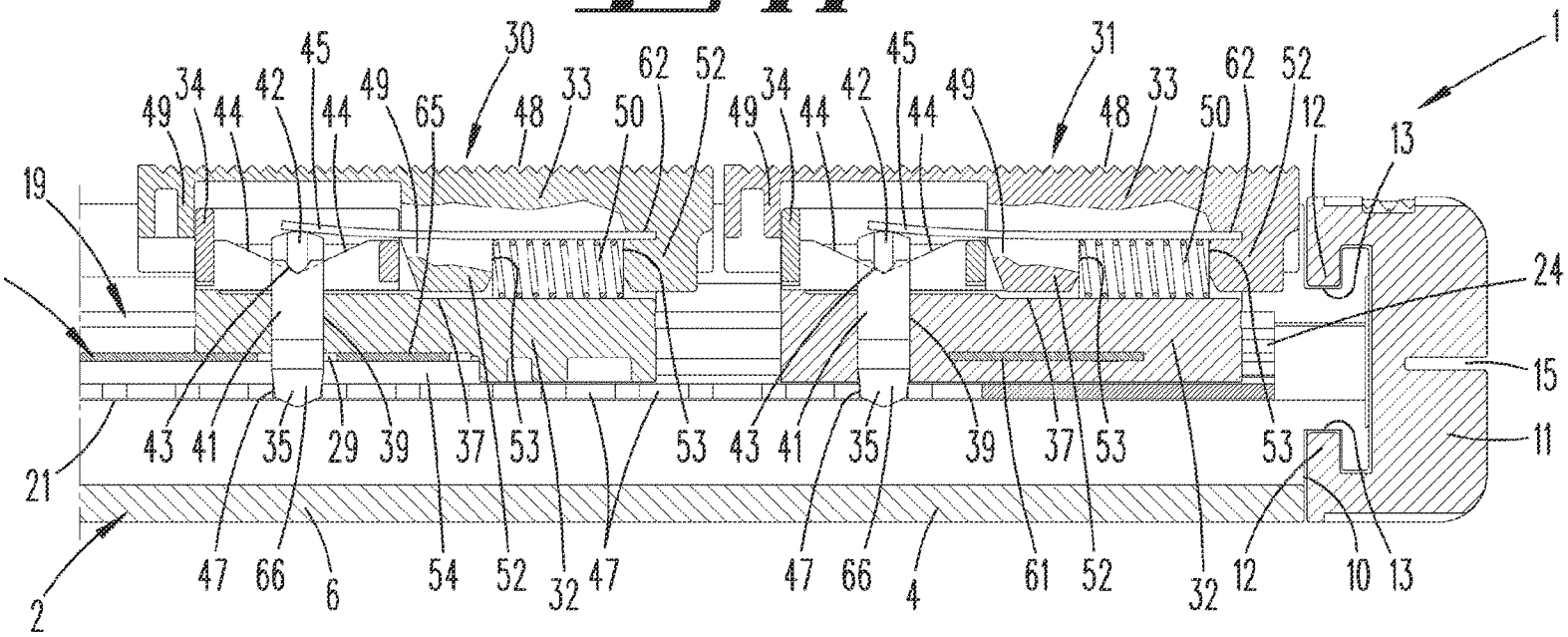
Figure 1B:
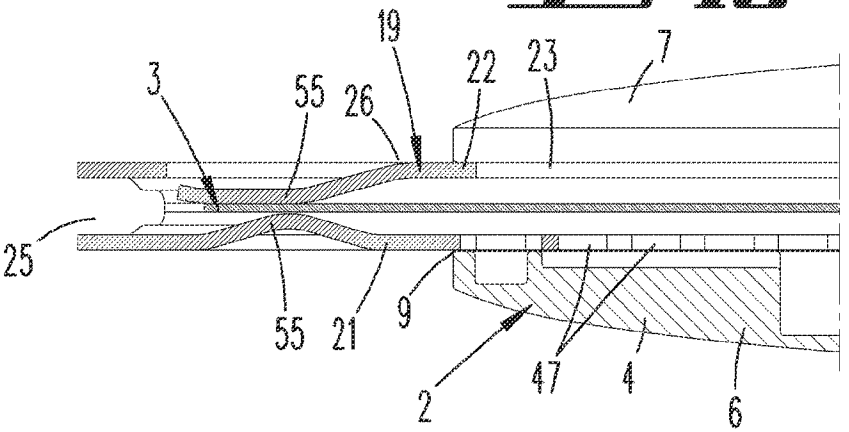
Figure 19:
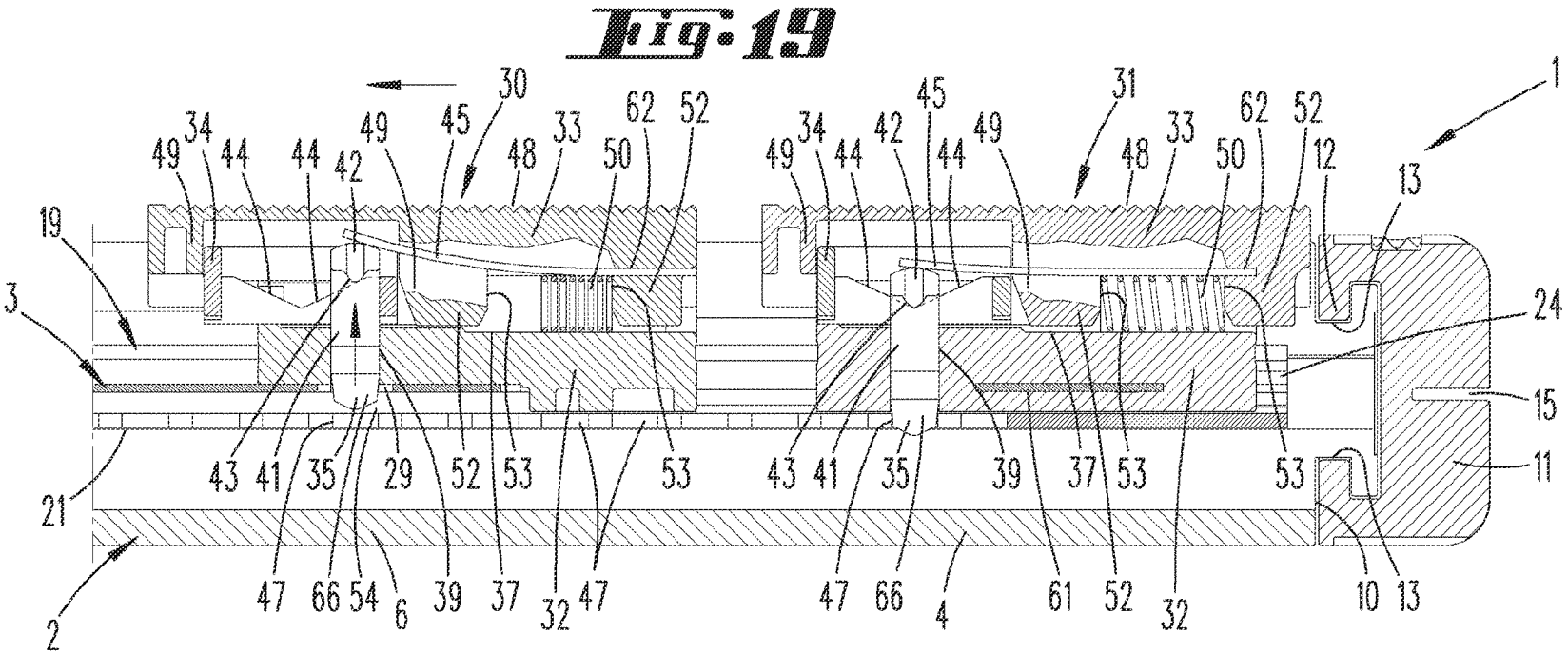
FIG. 19 shows an illustration according to FIG. 17, but in which the actuating part of a blade displacement carriage is displaced in a sliding manner in an extending direction in order to disengage a catching position.
Figure 20:
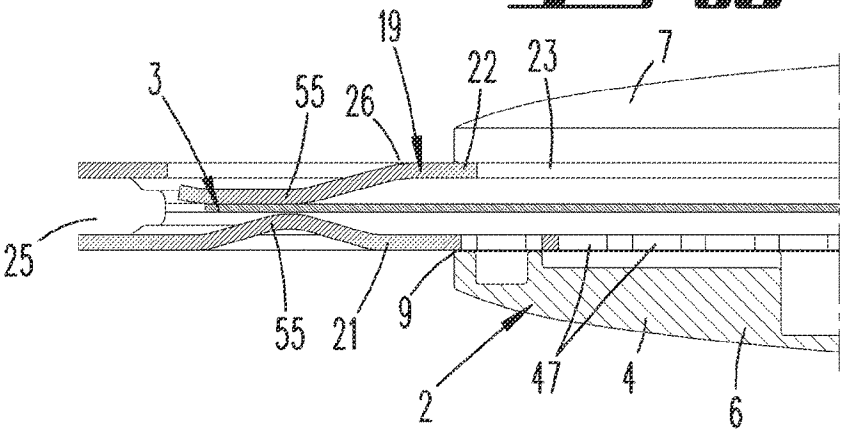
FIG. 20 shows an illustration according to FIG. 18, but concerning the position according to FIG. 19.
Figure 21:
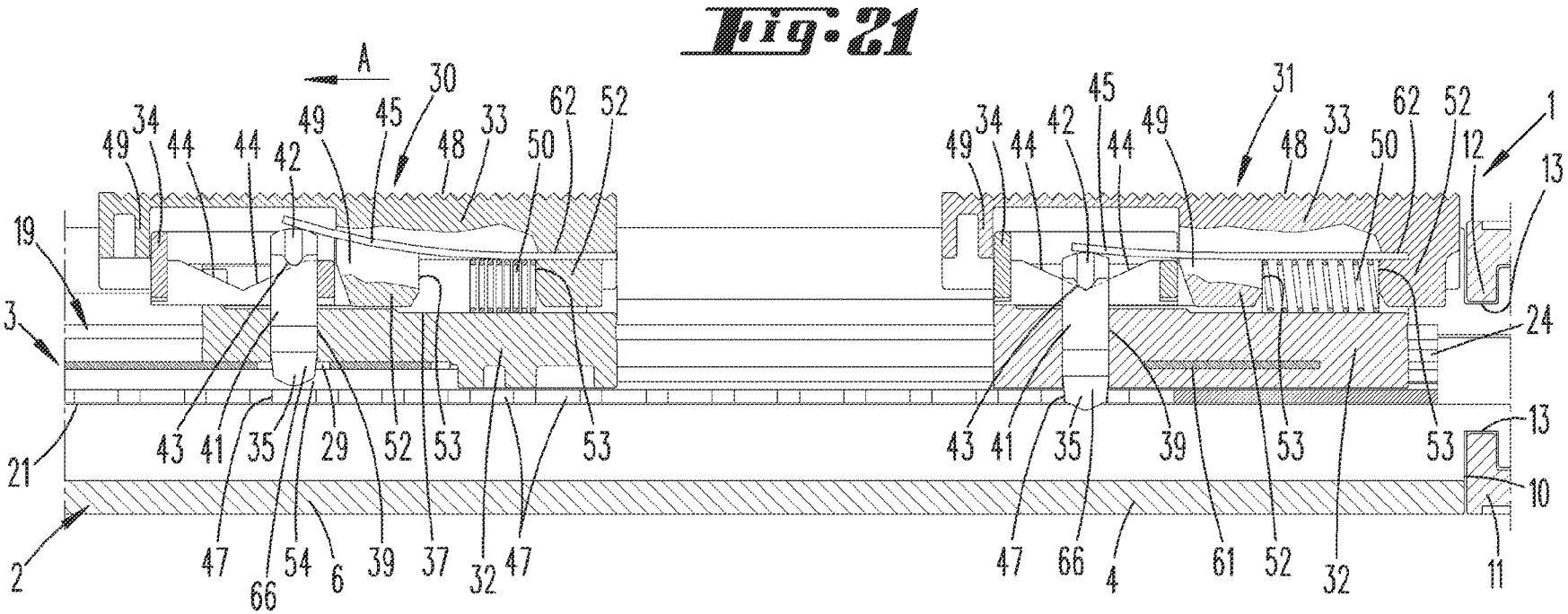
FIG. 21 shows a follow-up illustration to FIG. 19, in which the actuating part is additionally displaced in a sliding manner and drags along the entire blade displacement carriage with the blade retained thereon.
Figure 22:
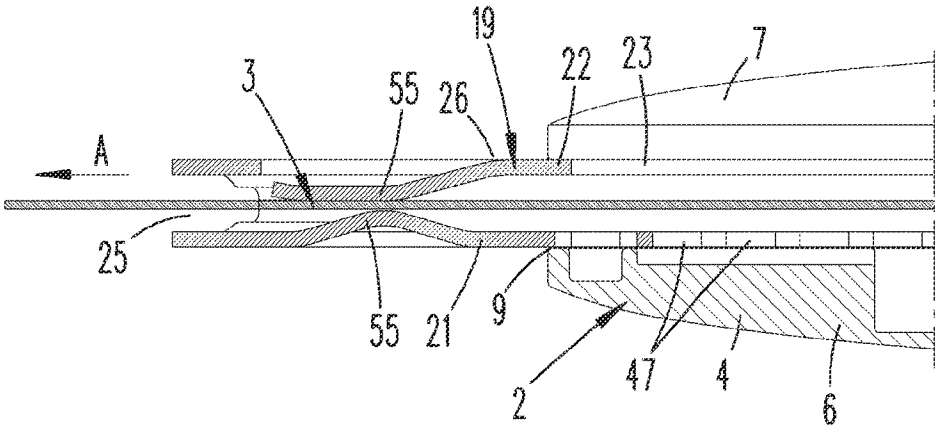
FIG. 22 shows an illustration according to FIG. 18, but concerning the follow-up illustration according to FIG. 21.
Figure 23:
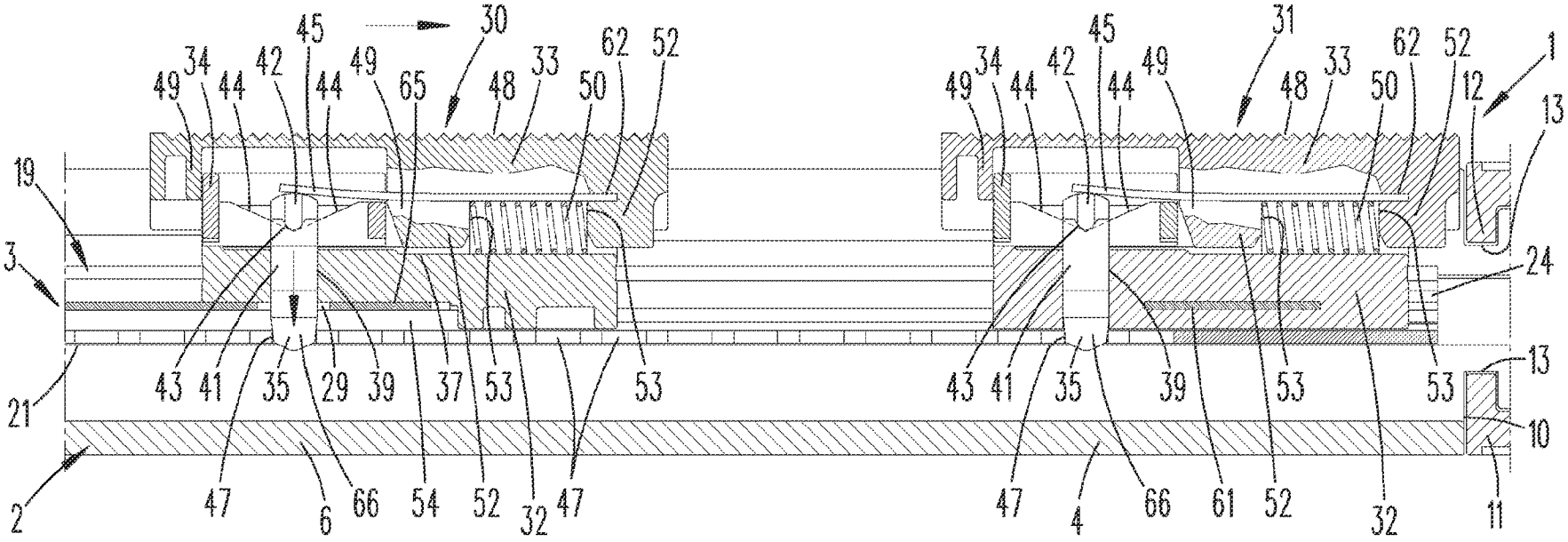
FIG. 23 shows a follow-up illustration to FIG. 21, in which the actuating part is no longer acted upon in a sliding manner and the catching position is assumed.

The cross sections in FIGS. 8 and 9, in particular, furthermore show that the receptacle bottom 21 of the displacement receptacle 19, which contains the catch openings 47, is optionally covered by the housing bottom 6 in a completely closed manner. The catch engagement may therefore take place in a concealed arrangement. In this case, the catch part 35 lies in a protected position within the respective displacement carriage 30 or 31.

In addition, a space 63 for accommodating, for example, additional blades 3 to be exchanged may be provided between the receptacle bottom 21 and the housing bottom 6, wherein said space is realized in an elongate manner in the longitudinal direction L and can be exposed by removing the closing cap 11.

FIGS. 30 to 39 show a second embodiment of an inventive knife 1.

Figure 34:
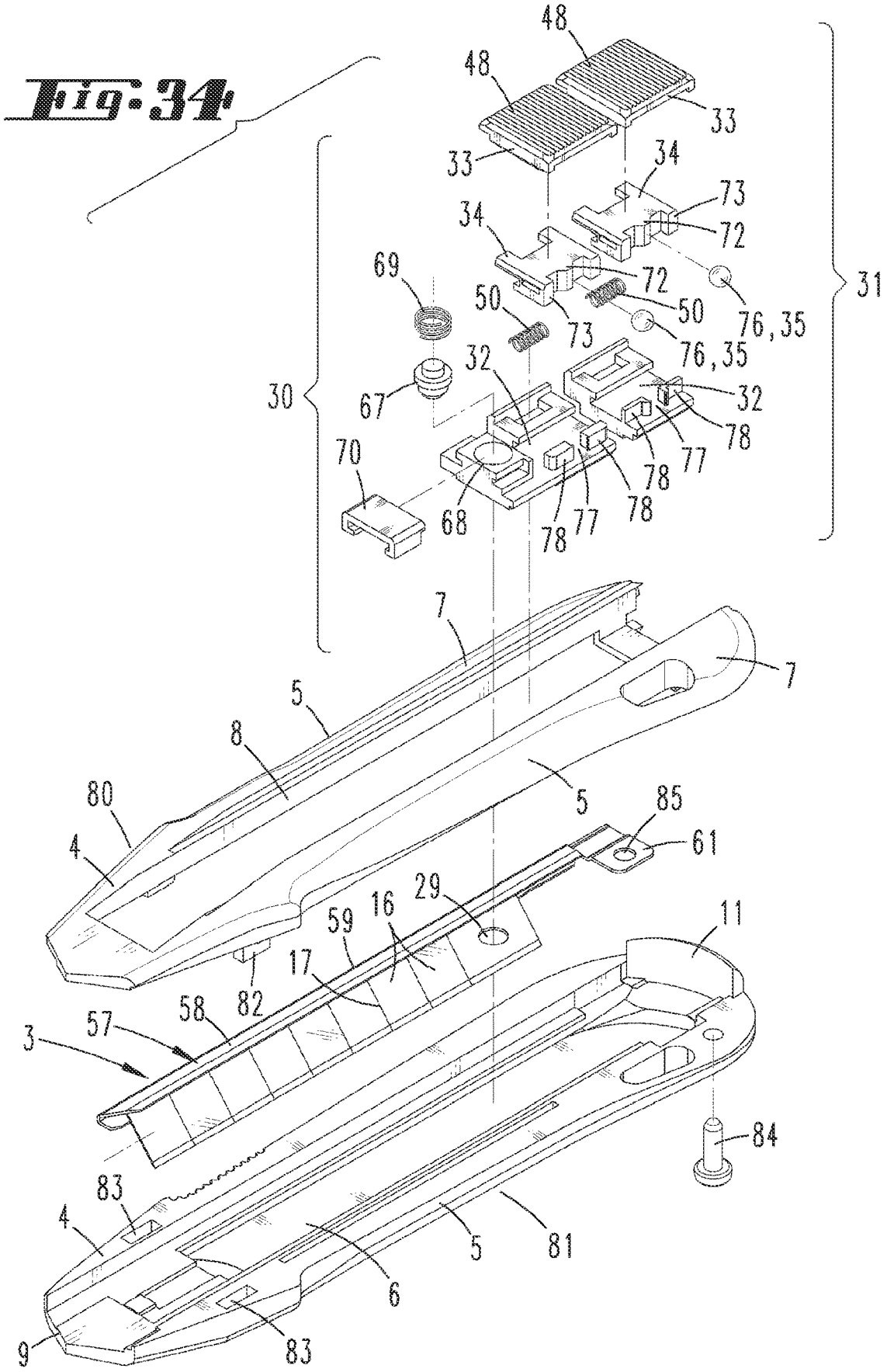
FIG. 34 shows an exploded perspective view of the knife.
Figure 35:
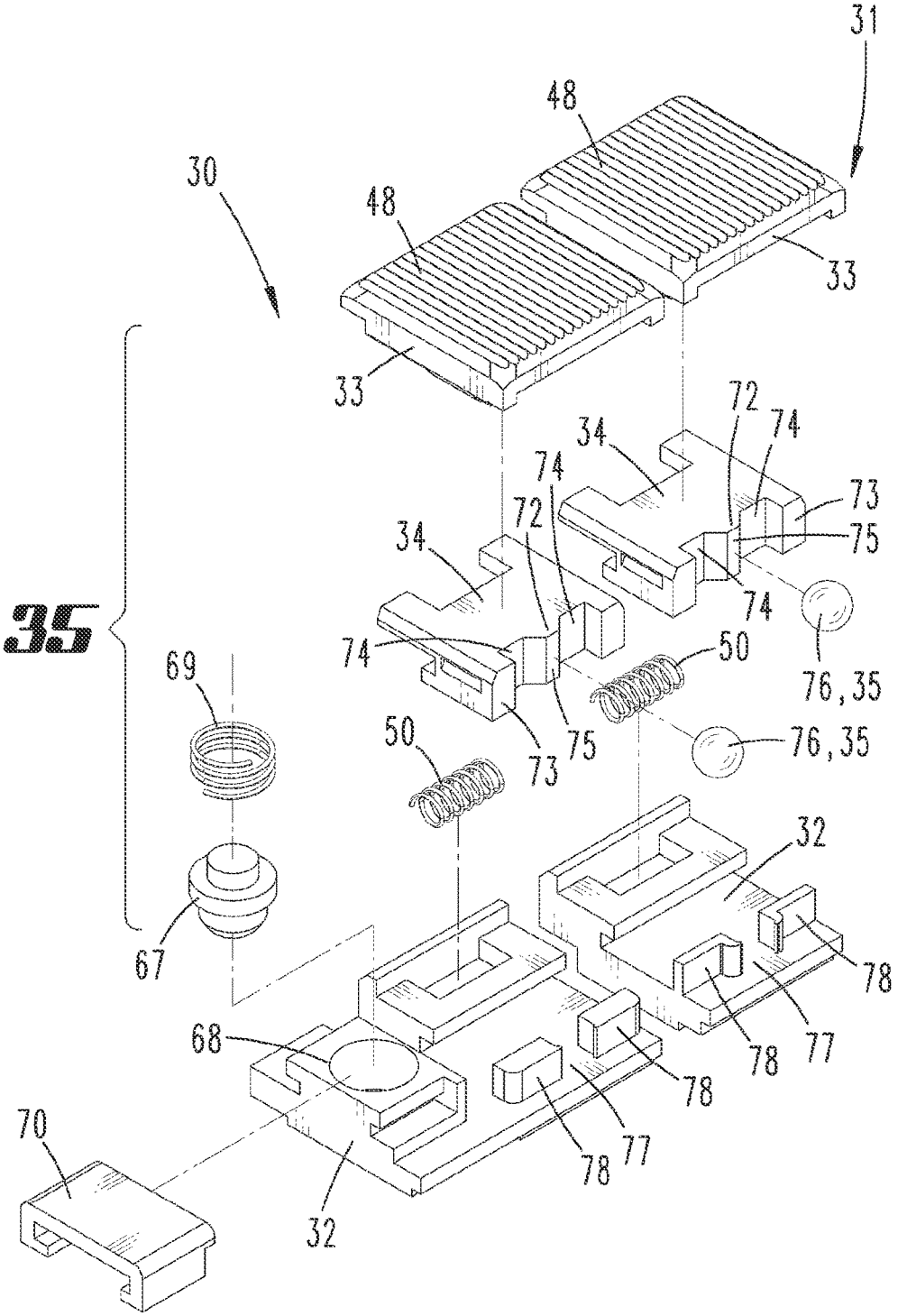
FIG. 35 shows an individual exploded perspective view of a blade displacement carriage and a reinforcing part displacement carriage.
Figure 36:
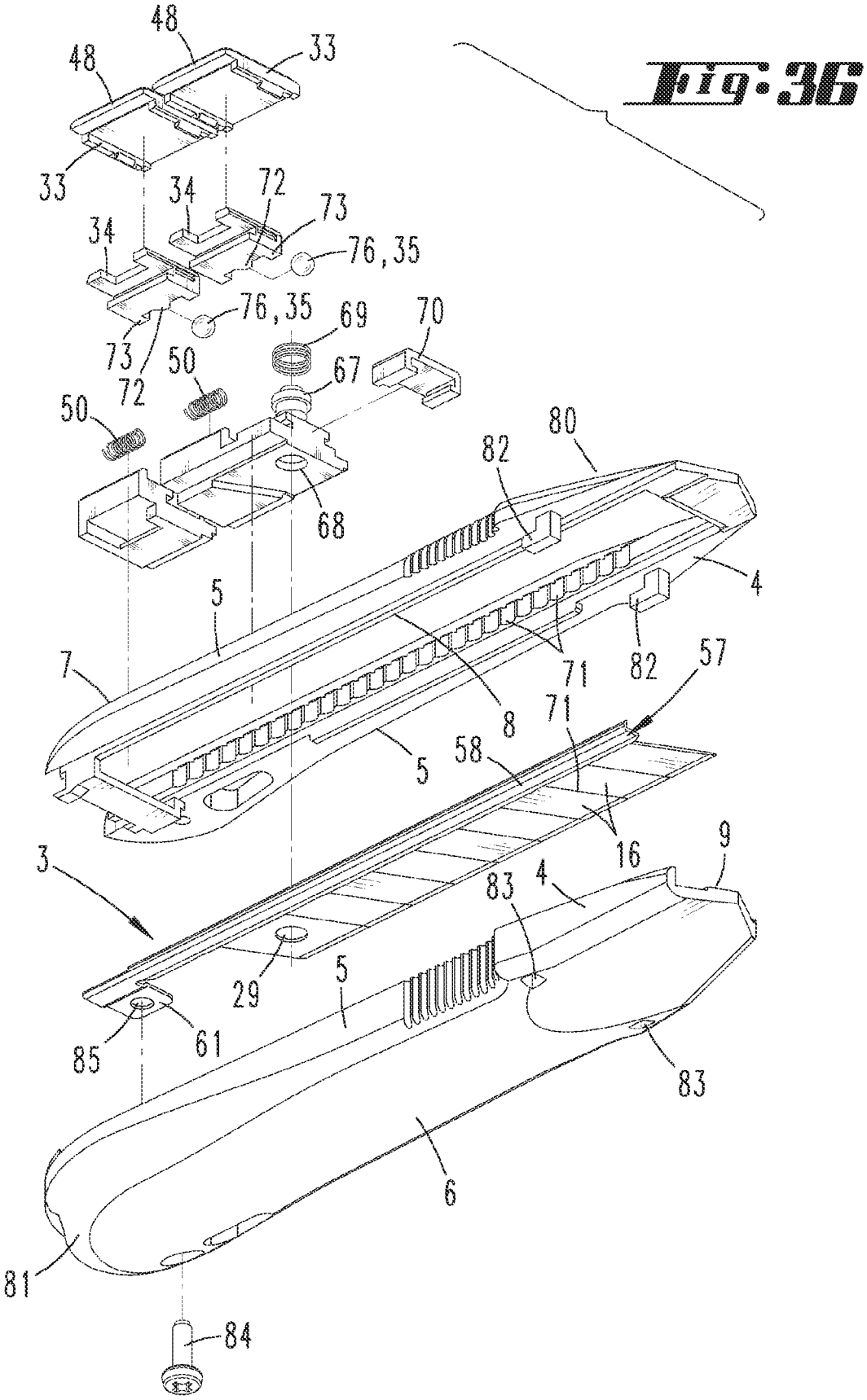
FIG. 36 shows an exploded perspective bottom view of the knife.
Figure 31:
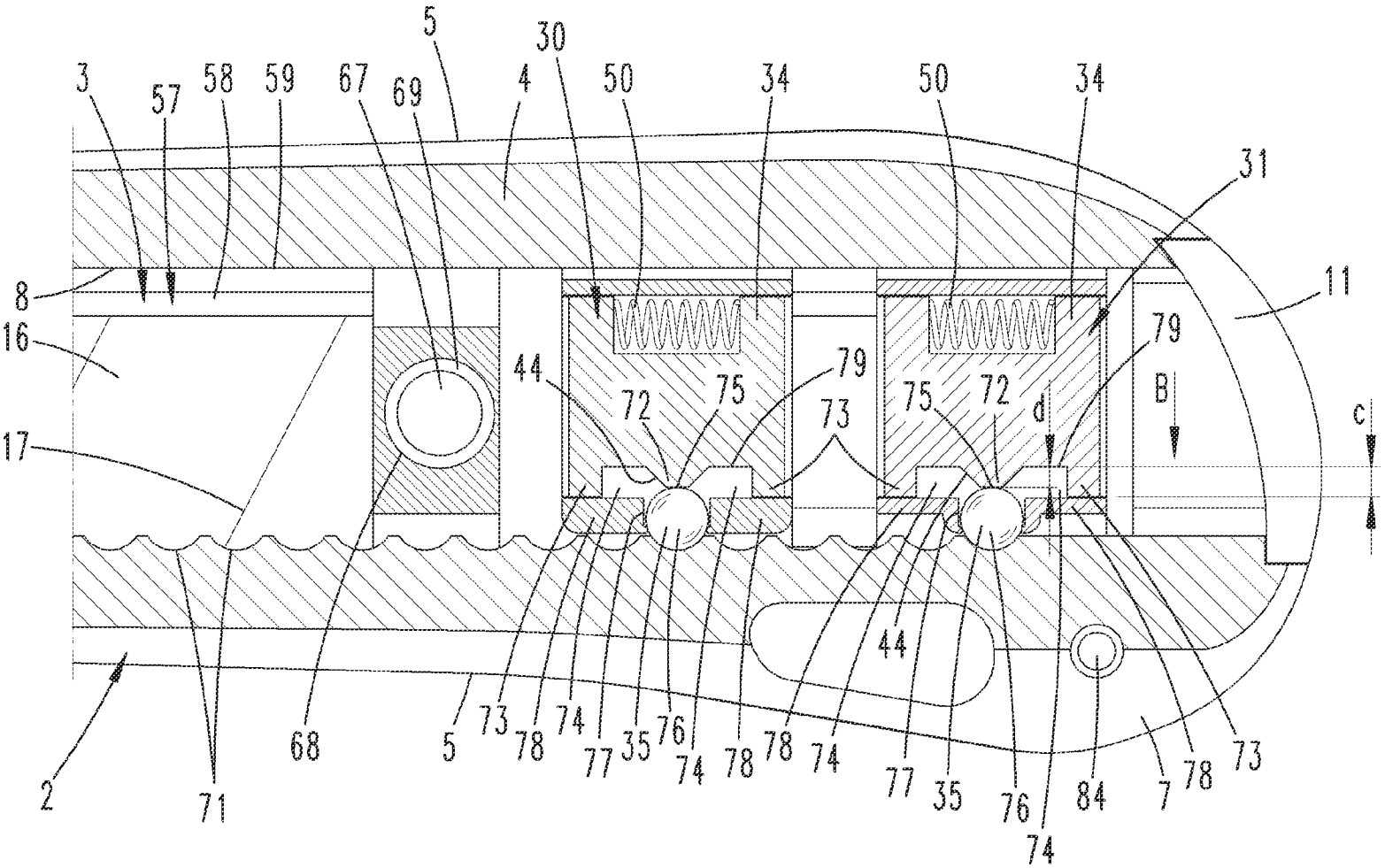
Figure 38:
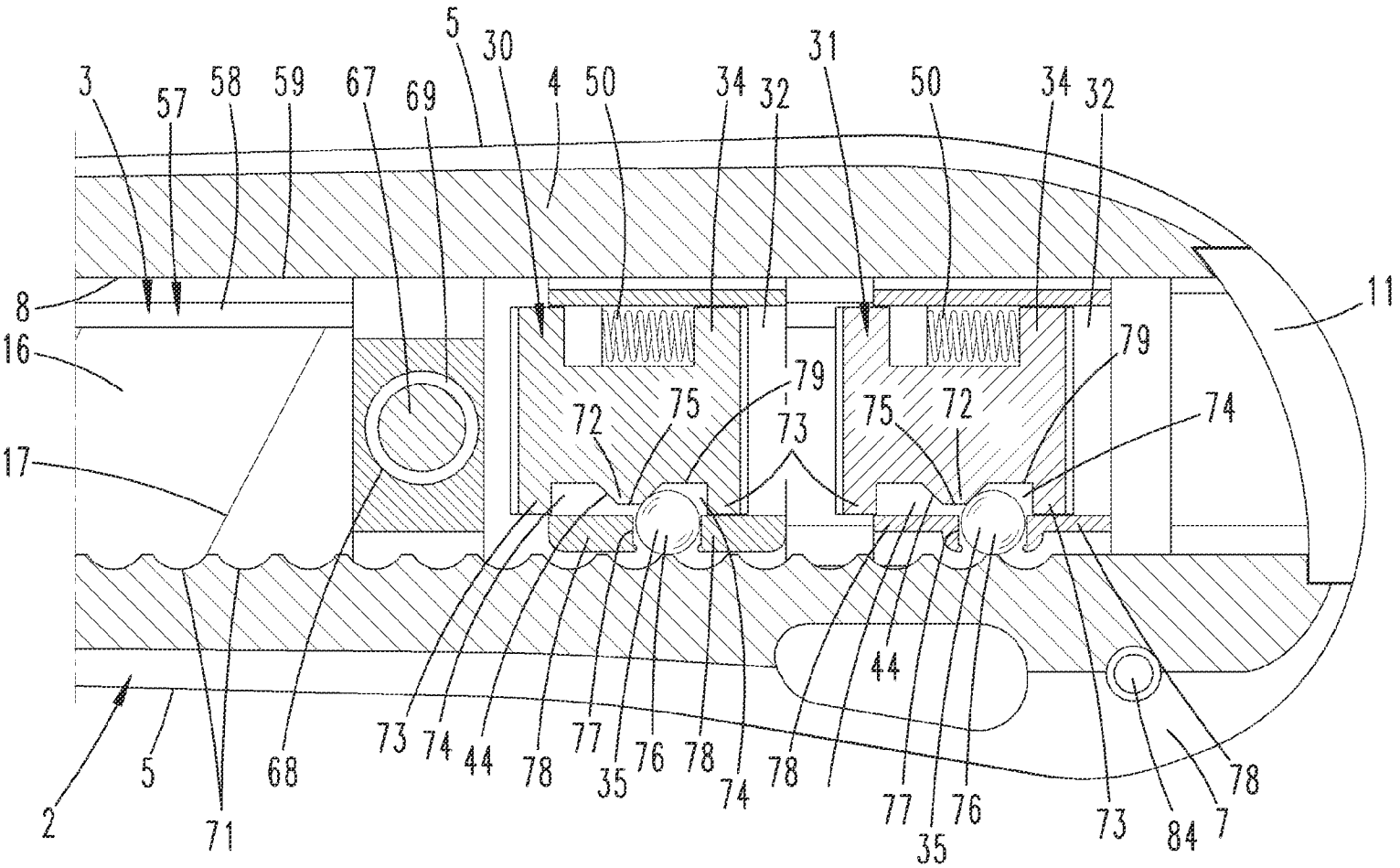
FIG. 38 shows an illustration corresponding to FIG. 37, but concerning a position after the disengagement of the catch mechanism.
Figure 39:
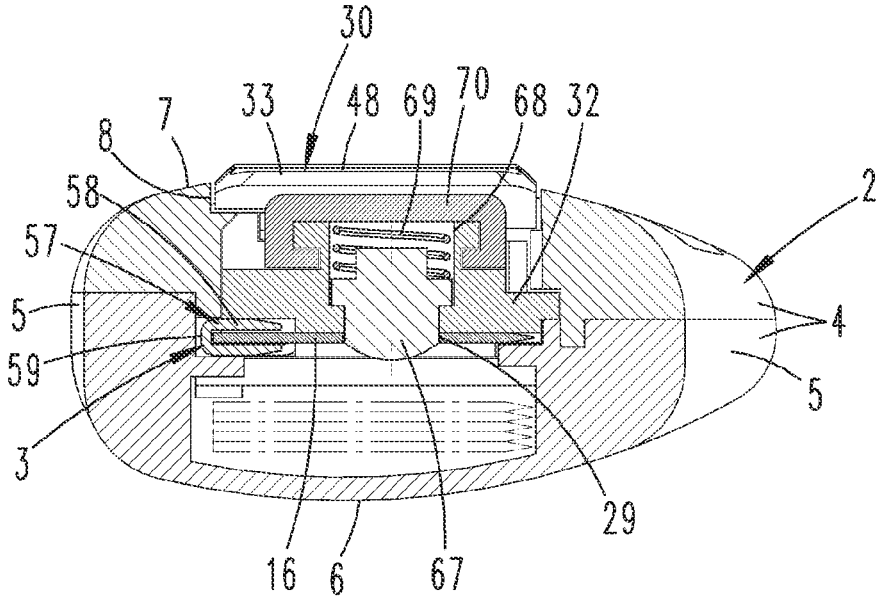
FIG. 39 shows a section along the line XXXIX-XXXIX in FIG. 32.

According to FIG. 34, for example, the housing 4 may comprise two shell-like parts, e.g. an upper housing part 80 and a lower housing part 81. The two housing parts 80 and 81 may be connected to one another by means of a catch mechanism as shown in order to form the complete housing 4. For example, one housing part may have a catch pin 82 that interacts with associated catch receptacles 83 of the other housing part in an engaging manner. The housing parts may additionally or alternatively also be connected by means of one or more screws 84.

In this exemplary embodiment, the blade 3 is alternatively retained on the blade displacement carriage 30 separately by means of a catch mechanism. A catch projection 67, which can be displaced perpendicular to a broad face extent of the blade 3, is provided for this purpose. This catch projection penetrates an opening 68 of the blade displacement carriage 30 on the bottom side and is guided in the carriage such that its displacement is limited, particularly in the direction of a catching position, by means of a stop. In addition, the catch projection 67 is spring-loaded in the direction of a catching position according to FIG. 39. A cylindrical pressure spring 69 may be provided for this purpose as shown, wherein said cylindrical pressure spring is supported on the catch projection 67 with one end and on a top section 70 of the blade displacement carriage 30 with the other end.

The catch projection 67 extends into the blade opening 29 through the opening 68 in order to fix the blade 3 on the blade displacement carriage 30.

The free end face of the catch projection 67 preferably is realized in a roof-like manner, e.g. in the form of a cap or, in particular, in the form of a spherical cap, such that the catch projection 67 initially is automatically displaced into an evasive position against the restoring force of the pressure spring 69 when a new blade 3 is inserted and can subsequently drop into the blade opening 29 under the influence of the pressure spring 69.

In this embodiment, a blade exchange preferably takes place after the displacement of the blade displacement carriage 30 into a front position, which preferably is limited by means of a stop, such that this blade exchange can be carried out through the front opening 9 of the knife 1. In the above-described first exemplary embodiment, a blade exchange is carried out through the rear opening 10 after releasing the displacement path by removing the closing cap 11.

Figure 40:
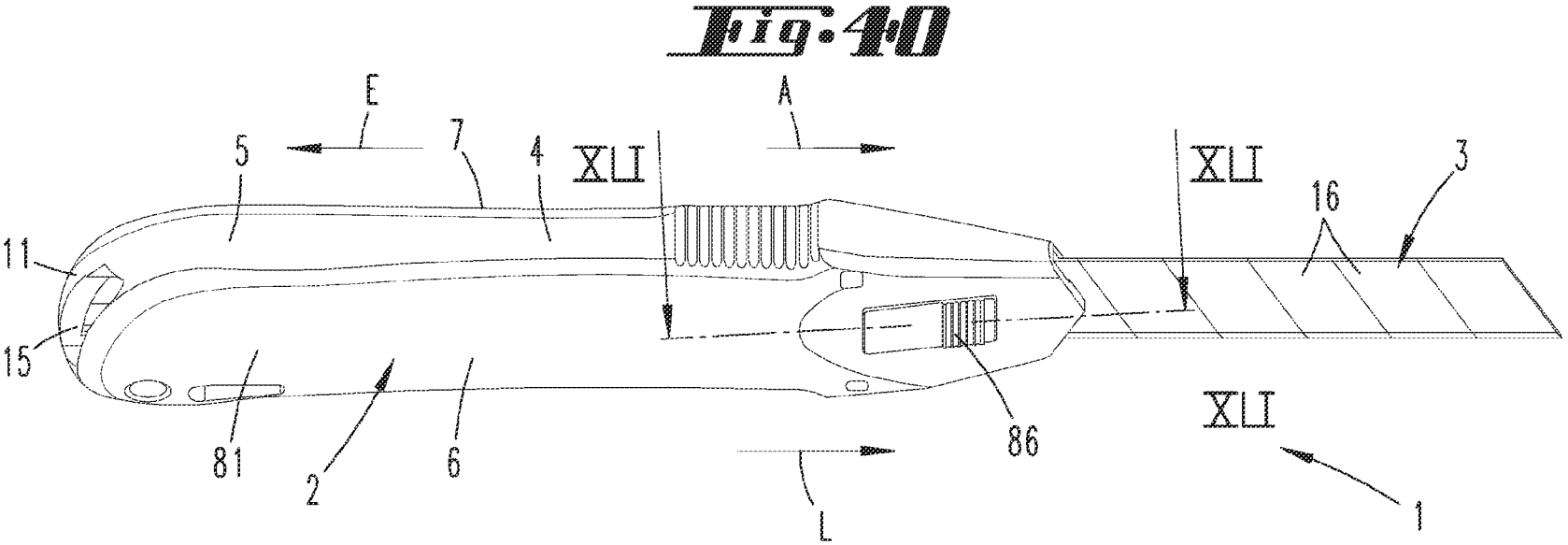
FIG. 40 shows a perspective rear view of the knife with maximally extended blade.
Figure 41:
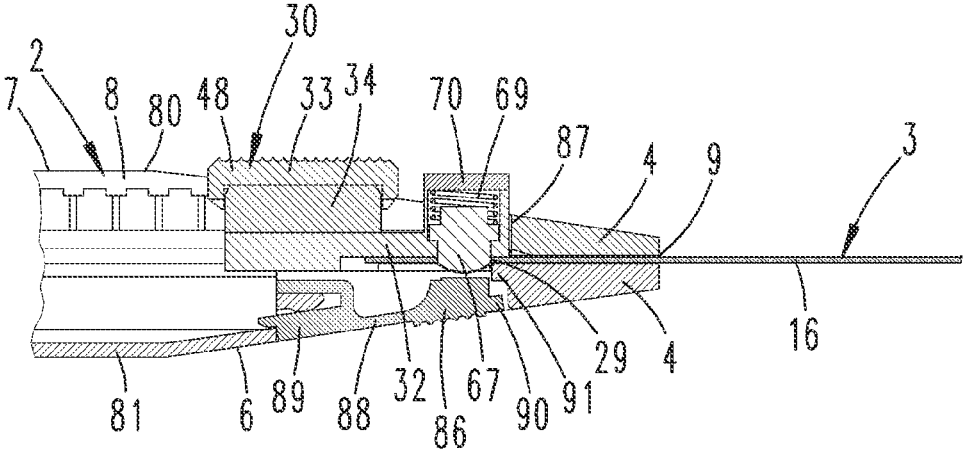
FIG. 41 shows a section along the line XLI-XLI in FIG. 40.

FIGS. 40 and 41 show the knife 1 in a preferred blade exchange position. The blade displacement carriage 30 is displaced into a frontmost position, which is limited by means of a stop, together with the blade 3. The carriage part 32, in particular, can abut on an associated stopping surface 87 of the housing 4 in this position (compare to FIG. 41).

In this position, a button 86 provided in the lower housing part 81 is associated with the catch projection 67 that interacts with the blade 3. The engagement between the blade 3 and the blade displacement carriage 30 can be disengaged by means of this button 86.

The button 86 is connected to a pedestal section 89 by means of an arm section 88 that acts, for example, in a spring-like manner. The pedestal section 89, the arm section 88 and the button 86 preferably are realized integrally and made of the same material.

The button 86 is retained on the housing 4, particularly on the lower housing part 81, by means of the pedestal section 89. The button 86, which freely protrudes via the arm section 88, is movable about a geometric pivoting axis that preferably is formed in the region of the arm section 88. In this case, the pivoting axis extends transverse to the longitudinal extent of the blade 3.

The pivoting motion of the button 86 takes place against a restoring force that is built up during the pivoting process, e.g. the restoring force of the arm section 88 that acts in a spring-like manner. Accordingly, the button 86 preferably can be returned in the direction of a basic position according to FIG. 41 in a spring-elastic manner.

The button 86 is accessible from the underside of the lower housing part 81. An actuation of the button 86 results in a pivoting displacement thereof in the direction of the facing catch projection 67. The facing button surface abuts on the end face of the catch projection 67 such that the catch projection 67 is as a result of a further pivoting displacement of the button 86 displaced against the force of the pressure spring 69, namely in such a way that the free and preferably cap-shaped end face of the catch projection 67 lies in the blade opening 29. In this position, the blade 3 can be pulled out forward through the front opening 9, wherein the opening edge of the blade opening 29 additionally pushes the catch projection 67 into the release position in interaction with the cap-shaped end face of the catch projection 67.

Figure 42:
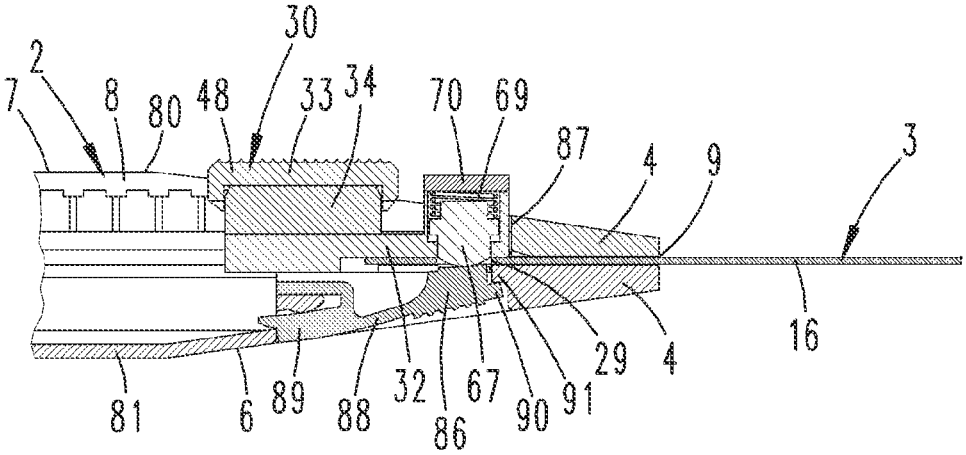
FIG. 42 shows a sectional view corresponding to FIG. 41, but concerning a catch disengagement position for a potential removal of the blade.

In this position, the facing end face of the button 86 preferably lies underneath a plane defined by the underside of the blade 3. Accordingly, the facing end face of the button 86 does not engage into the blade opening 29, preferably not even partially. This can be achieved due to an abutment of a stop shoulder 90 of the button on a counterstop shoulder 91 of the housing as shown (compare to FIG. 42).

In the second exemplary embodiment, the closing cap 11 may solely serve for closing the space 63 for accommodating replacement blades. The closing cap 11 may alternatively or additionally also form the rear boundary of the carriage space as in the first exemplary embodiment.

In the first embodiment illustrated in FIGS. 1-29, the catch engagement of the blade displacement carriage 30 and/or the reinforcing part displacement carriage 31 essentially takes place in a direction extending perpendicular to the longitudinal direction L and therefore essentially in a depth direction of the knife 1 whereas this catch engagement essentially takes place in a width direction B extending transverse to the longitudinal direction L in the second embodiment.

As in the first exemplary embodiment, each displacement carriage 30, 31 is initially and essentially also composed of a carriage part 32 and a wedge carriage part 34 in the second exemplary embodiment, wherein the wedge carriage part 34 can be moved relative to the carriage part 32 in the longitudinal direction L. The actuation is also realized by means of an actuating part 33 in this case.

The catch engagement of the respective carriage 30, 31 takes place as a result of the interaction between a catch part 35 of the carriage and catch depressions 71 provided on the inner wall side of the narrow receptacle side 20 or the inner wall side of the narrow housing side 5. These catch depressions 71 are uniformly distributed over the length as it is also the case with the catch openings 47 in the displacement receptacle 19 in the above-described exemplary embodiment.

Since it is possible to manufacture the housing 4 of a metallic material, e.g. in the form of a magnesium, zinc or aluminum pressure die casting, the catch depressions 71 can be formed in a sufficiently stable manner directly on the housing 4. If the housing is made of metal, a separate displacement receptacle 19 of the type provided in the above-described first exemplary embodiment may be unnecessary.

The wedge carriage part 34, which is also motion-coupled to the actuating part 33 in the second embodiment, may be displaceable relative to the carriage part 32 in a sliding manner, particularly with respect to the blade displacement carriage 30, against the restoring force of a spring 50, e.g. a cylindrical pressure spring. The spring 50 makes it possible to achieve a neutral center position of the wedge carriage part 34.

The wedge carriage part 34 preferably is provided with a catch projection 72, which points in the direction of the catch depression 71, centrally referred to its longitudinal extent. A displacement projection 73 is formed at a distance in front of the catch projection 72 referred to the extending direction A and an additional displacement projection 73 preferably is provided behind the catch projection 72 referred to the extending direction A.

With respect to a top view according to FIG. 37, the catch projection 72 and the two displacement projections 73 may originate from a common end face of the wedge carriage part 34, which in a top view is illustrated in the form of a line. A pocket-like catch part receptacle 74, the edge of which is open in the direction of the catch depressions 71, is respectively formed between the catch projection 72 and the respective displacement projection 73. The boundary of each catch part receptacle 74 in the direction facing the central catch projection 72 is formed by a wedge surface 44. Both wedge surfaces 44 lead into a pan-like supporting surface 75 of the catch projection 72.

The catch part 35, which preferably is realized in the form of a ball 76 in the second exemplary embodiment, can be supported by means of the supporting surface 75 in the catching position. Alternatively, the catch part 35 may also be formed by a circular cylinder instead of a ball 76. In this catching position according to FIG. 37, the catch part 35 is captured between the supporting surface 75 of the catch projection 72 and an associated catch depression 71 such that the ball 76 is prevented from evading transverse to the extending direction A or transverse to the retracting direction E. In this way, the selected extending position or retracting position of the blade 3 is secured by a catch.

The ball 76 furthermore may be captured—referred to the longitudinal direction L—in a recess 77 of a carriage wall 78 such that the ball 76 can only carry out a displacement in the width direction B. Such a displacement for disengaging the catch mechanism can be achieved by respectively displacing the wedge carriage part 34 in a sliding manner in the longitudinal direction L or in the extending direction A or the retracting direction E according to the first exemplary embodiment. A catch part receptacle 74 of the wedge carriage part 34 is respectively associated with the catch part 35 or in this case the ball 76 due to such a sliding displacement (see FIG. 38). In the course of the further sliding displacement of the carriage part 32 together with the wedge carriage part 34, the ball 76 is dragged along in the displacement direction by means of the displacement projection 73. Due to the pan-shaped design of the catch depressions 71, the ball 76 is in the process pushed out of the catch depression 71 and into the catch part receptacle 74 (see FIG. 38).

In this embodiment, the wedge carriage part 34 can also be displaced back into the central position again in a spring-assisted manner when the actuating part 33 is released. The catch part 35, particularly the ball 76, preferably is controlled outward in the width direction B in this case. The ball 76 is pushed into the catch depression 71 by means of the wedge surface 44. The ball 76 is captured between the catch depression 71 and the supporting surface 75 of the catch projection 72 once the central position of the wedge carriage part 34 is reached. The catching position is therefore assumed again.

The displacement projections 73 preferably protrude by a greater dimension c than the catch projection 72 (dimension d) starting from the longitudinal side 79, from which the displacement projections 73 and the catch projection 72 originate. The resulting differential dimension (dimension c minus dimension d) may approximately correspond to one-fifth of the maximum dimension of the catch part 35 in the width direction B, i.e. to approximately one-fifth of the diameter of the ball 76 in the second exemplary embodiment. In the course of a displacement process, each displacement projection 73 preferably acts upon the ball 76 in the region of an upper ball half that faces the respective slide.

The extension arm 61 of the reinforcing part 57 may lie in a pocket-like recess of the carriage part 32 of the reinforcing part displacement carriage 30 as it is also the case in the first embodiment. An optional form-fitted retention, e.g. on a pin of the carriage part 32, may additionally or alternatively also be provided, wherein a bore-like receptacle 85 may be provided in the region of the extension arm 61 for this purpose.

The preceding explanations serve for elucidating all inventions that are included in this application and respectively enhance the prior art independently with at least the following combinations of characteristics, wherein two, multiple or all of these combinations of characteristics may also be combined with one another, namely:

A knife, which is characterized by a reinforcing part 57, on which an extended region of the blade 3 can be supported, wherein the reinforcing part 57 is displaceable relative to the knife handle 2 and detachably connected to the blade 3.

A knife, which is characterized in that the catch mechanism is formed underneath the region, in which the blade 3 or an imaginary extension of the blade 3 extends, viewed from the blade displacement carriage 30 and/or the reinforcing part displacement carriage 31.

A knife, which is characterized in that the catch mechanism is formed underneath the region, in which the blade 3 or an imaginary extension of the blade 3 extends, viewed from the blade displacement carriage 30 and/or the reinforcing part displacement carriage 31.

A knife, which is characterized in that the blade displacement carriage 30 has a retaining magnet 56 for interacting with the blade 3 in a retaining manner.

A knife, which is characterized in that a closing cap 11 is arranged on the knife handle 2 at the rear end of the blade 3, wherein said closing cap closes the displacement path for the blade displacement carriage 30 and/or the reinforcing part displacement carriage 31.

A knife, which is characterized in that the reinforcing part 57 can be displaced relative to the blade 3.

A knife, which is characterized in that the knife handle 2 is realized in an elongate manner and has a longitudinal direction L.

A knife, which is characterized in that the blade 3 can be displaced in the longitudinal direction L.

A knife, which is characterized in that the reinforcing part 57 can be displaced in the longitudinal direction L.

A knife, which is characterized in that the reinforcing part 57 is designed for encompassing an outer edge 60 of the blade 3.

A knife, which is characterized in that the reinforcing part 57 has a U-shaped cross section.

A knife, which is characterized in that the knife handle 2 has a displacement receptacle 19 for a blade displacement carriage 30 that is connected to the blade 3.

A knife, which is characterized in that the knife handle 2 has a displacement receptacle 19 for a reinforcing part displacement carriage 31 that is connected to the reinforcing part 57.

A knife, which is characterized in that the blade displacement carriage 30 and the reinforcing part displacement carriage 31 are arranged in the same displacement receptacle 19.

A knife, which is characterized in that the blade displacement carriage 30 and the reinforcing part displacement carriage 31 are arranged behind one another in the displacement receptacle 19.

A knife, which is characterized in that the blade 3 is realized in the form of a flat part with an essentially constant thickness in a longitudinal direction, as well as in a transverse direction.

A knife, which is characterized in that the blade 3 has predetermined breaking points 17 for snapping off a worn out blade segment 16.

A knife, which is characterized in that a catch part 35, which is accommodated in the blade displacement carriage 30 and/or in the reinforcing part displacement carriage 31, and catch openings 47, which are arranged behind one another in the longitudinal direction L in the knife handle 2, are provided in order to realize the catch engagement.

A knife, which is characterized in that the catch part 35 accommodated in the blade displacement carriage 30 penetrates the blade 3 in the region of a blade opening 29.

A knife, which is characterized in that the catch part 35 accommodated in the blade displacement carriage 30 penetrates the blade 3 in the engaged state, as well as during a movement of the blade 3 from a first into a second catching position.

A knife, which is characterized in that a catch projection 67, which is realized separately of the catch part 35, is provided on the blade displacement carriage 30 and penetrates the blade opening 29 in order to retain the blade 3.

A knife, which is characterized in that the catch projection 67 is spring-loaded into the catching position by means of a spring 69.

A knife, which is characterized in that the catch retention of the blade 3 on the catch projection 67 of the blade displacement carriage 30 can be disengaged by actuating a button 86 provided on the housing.

A knife, which is characterized in that the blade displacement carriage 30 and/or the reinforcing part displacement carriage 31 has an actuating part 33 and a carriage part 32, wherein the actuating part 33 can be moved relative to the carriage part 32 in the longitudinal direction L.

A knife, which is characterized in that the actuating part 33 causes the catch part 35 to be pulled out of the catch opening 47 when it is acted upon in the longitudinal direction L.

A knife, which is characterized in that the actuating part 33 can be displaced in the longitudinal direction L together with the carriage part 32 after the disengagement of the catch mechanism.

A knife, which is characterized in that the catch part 35 is spring-loaded into the catching position by means of a spring 50.

A knife, which is characterized in that the spring 50 is a leaf spring or a cylindrical spring.

A knife, which is characterized in that the actuating part 33 interacts with the carriage part 32 by means of a spring 50 acting in the longitudinal direction L.

A knife, which is characterized in that the spring 50 is supported in the carriage part 32 with both ends, but can be lifted off a respective supporting surface 53 by the actuating part 33 when the actuating part 33 is acted upon in the longitudinal direction L.

A knife, which is characterized in that a wedge carriage part 34 is provided and can be moved relative to the carriage part 32 in the longitudinal direction L by means of the actuating part 33 in order to act upon the catch part 35.

A knife, which is characterized in that the catch part 35 has an application surface 43, which is exposed transverse to the longitudinal direction L and serves for interacting with the wedge carriage part 34.

A knife, which is characterized in that the closing cap 11 is fastened on the knife handle 2 in a sliding manner transverse to the longitudinal extent.

A knife, which is characterized in that the closing cap 11 is retained on the knife handle 2 in a pivoting or folding manner.

A knife, which is characterized in that the closing cap 11 has a groove 15, which is exposed toward the outside, in order to make available a snap-off aid when the closing cap 11 is removed.

A knife, which is characterized in that a magnet 18 is arranged in the closing cap 11 in association with the groove 15 in order to retain a snapped off blade segment 16.

A knife, which is characterized in that the catch part 35 is movable transverse to a displacement direction of the blade displacement carriage 30 and/or the reinforcing part displacement carriage 31 in order to realize its respective disengagement or engagement.

A knife, which is characterized in that the blade displacement carriage 30 and/or the reinforcing part displacement carriage 31 has a width, wherein a width direction B of the reinforcing part displacement carriage 31 and/or the blade displacement carriage 30 corresponds to a width of the blade 3, and in that the catch part 35 is movable in the width direction B of the blade displacement carriage 30 and/or the reinforcing part displacement carriage 31.

A knife, which is characterized in that the catch part 35 is a ball 76 or a cylinder.

A knife, which is characterized in that the catch part 35 is a catch pin 66.

A knife, which is characterized in that the blade displacement carriage 30 and/or the reinforcing part displacement carriage 31 has on a longitudinal side 79 a catch projection 72 for interacting with the catch part 35 in a catching position.

A knife, which is characterized in that the blade displacement carriage 30 and/or the reinforcing part displacement carriage 31 has a displacement projection 73 for interacting with the catch part 35 in a release position.

A knife, which is characterized in that the displacement projection 73 protrudes farther than the catch projection 72 in the width direction B.

All disclosed characteristics are essential to the invention (individually, but also in combination with one another). The disclosure of the associated/attached priority documents (copy of the priority application) is hereby fully incorporated into the disclosure content of this application, namely also for the purpose of integrating characteristics of these documents into claims of the present application. The characteristics of the dependent claims also characterize independent inventive enhancements of the prior art without the characteristics of a claim to which they refer, particularly for submitting divisional applications on the basis of these claims. The invention specified in each claim may additionally comprise one or more of the characteristics that were disclosed in the preceding description and, in particular, are identified by reference symbols and/or included in the list of reference symbols. The invention also concerns design variations, in which individual characteristics cited in the preceding description are not realized, particularly as far as they are obviously dispensable for the respective intended use or can be replaced with other, identically acting technical means.

REFERENCE LIST

1 Knife
2 Knife handle
3 Blade
4 Housing
5 Narrow housing side
6 Housing bottom
7 Housing top
8 Slot opening
9 Front opening
10 Rear opening
11 Closing cap
12 Guide web
13 Guide groove
14 Stop
15 Groove
16 Blade segment
17 Predetermined breaking line
18 Magnet
19 Displacement receptacle
20 Narrow receptacle side
21 Receptacle bottom
22 Receptacle top
23 Slot opening
24 Rear opening
25 Front opening
26 Section
27 Receptacle
28 Cutting edge
29 Blade opening
30 Blade displacement carriage
31 Reinforcing part displacement carriage
32 Carriage part
33 Actuating part
34 Wedge carriage part
35 Catch part
36 Receptacle groove
37 Box bottom
38 Box wall
39 Opening
40 Opening
41 Waist section
42 Pin section
43 Application surface
44 Wedge surface
45 Spring
46 Fastening element, fastening part
47 Catch opening
48 Actuating surface
49 Driving projection
50 Spring
51 Spring receptacle
52 Projection
53 Supporting surface
54 Receptacle pocket
55 Spring section
56 Magnet
57 Reinforcing part
58 U-limb
59 U-crosspiece
60 Outer edge
61 Extension arm
62 Receptacle
63 Space
64 Contact surface
65 Supporting surface
66 Catch pin
67 Catch projection
68 Opening
69 Pressure spring
70 Top section
71 Catch depression
72 Catch projection
84 Displacement projection
74 Catch part receptacle
75 Supporting surface
76 Ball
77 Recess
78 Carriage wall
79 Longitudinal side
80 Upper housing part
81 Lower housing part
82 Catch pin
83 Catch receptacle
84 Screw
85 Receptacle
86 Button
87 Stopping surface
88 Arm section
89 Pedestal section
90 Stop shoulder
91 Counterstop shoulder
A Extending direction
B Width direction
E Retracting direction L Longitudinal direction
c Dimension
d Dimension

The invention claimed is:

1. A knife (12) comprising a knife handle (2), a blade (3), wherein the blade (3) is configured to be extended and retracted relative to the knife handle (2), a blade displacement carriage (30) and/or a reinforcing part displacement carriage (31), and a catch mechanism for indexed adjustment of different extending positions of the blade (3), wherein the catch mechanism is formed underneath a region, in which the blade (3) or an imaginary extension of the blade (3) extends, viewed from the blade displacement carriage (30) and/or the reinforcing part displacement carriage (31), wherein the catch mechanism comprises a catch part (35), which is accommodated in the blade displacement carriage (30) and/or in the reinforcing part displacement carriage (31), and catch openings (47), which are arranged behind one another in a longitudinal direction (L) in the knife handle (2), in order to realize a catch engagement with the catch part, and wherein the catch part (35) accommodated in the blade displacement carriage (30) penetrates the blade (3) in an engaged state, as well as during a movement of the blade (3) from a first into a second catching position.

2. The knife according to claim 1, wherein the blade displacement carriage (30) has a retaining magnet (56) for interacting with the blade (3) in a retaining manner.

3. The knife (121 according to claim 1, wherein a closing cap (11) is arranged on the knife handle (2) at a rear end of the blade (3), wherein said closing cap closes a displacement path for the blade displacement carriage (30) and/or the reinforcing part displacement carriage (31).

4. The knife according to claim 1, wherein the catch part (35) accommodated in the blade displacement carriage (30) penetrates the blade (3) in the region of a blade opening (29) of the blade.

5. The knife according to claim 1, wherein a catch projection (67), which is realized separately of the catch part (35), is provided on the blade displacement carriage (30) and penetrates a blade opening (29) of the blade in order to retain the blade (3).

6. A knife (12) comprising a knife handle (2), a blade (3), wherein the blade (3) is configured to be extended and retracted relative to the knife handle (2), and a reinforcing part (57), on which an extended region of the blade (3) can be supported, wherein the reinforcing part (57) is displaceable relative to the knife handle (2) and detachably connected to the blade (3), wherein the knife handle (2) has a blade displacement carriage (30) and a reinforcing part displacement carriage (31) wherein the reinforcing part displacement carriage (31) has a catch mechanism comprising a catch part (35) accommodated in the reinforcing part displacement carriage (31) as well as catch openings (47) which are arranged one behind another in a longitudinal direction (L) in the knife handle (2) in order to realize a catch engagement with the catch part.

7. The knife according to claim 6, wherein the blade displacement carriage (30) has a retaining magnet (56) for interacting with the blade (3) in a retaining manner.

8. The knife according to claim 6, wherein the reinforcing part (57) can be displaced relative to the blade (3).

9. The knife according to claim 6, wherein the knife handle (2) is realized in an elongate manner and has a longitudinal direction (L).

10. The knife according to claim 9, wherein the blade (3) can be displaced in the longitudinal direction (L).

11. The knife according to claim 9, wherein the reinforcing part (37) can be displaced in the longitudinal direction (L).

12. The knife according to claim 6, wherein the reinforcing part (57) is designed for encompassing an outer edge (60) of the blade (3).

13. The knife according to claim 6, wherein the reinforcing part (57) has a U-shaped cross section.

14. The knife according to claim 6, wherein the blade displacement carriage (30) and the reinforcing part displacement carriage (31) are arranged behind one another in the displacement receptacle (19).

* * * * *